US010549343B2

(12) United States Patent
Nishida et al.

(10) Patent No.: US 10,549,343 B2
(45) Date of Patent: Feb. 4, 2020

(54) SYSTEM AND METHOD FOR TRANSPORTING MOLTEN METAL

(71) Applicants: SINTOKOGIO, LTD., Aichi (JP); FUJIWA DENKI CO., LTD., Aichi (JP)

(72) Inventors: Tadashi Nishida, Aichi (JP); Masanori Hoshino, Aichi (JP)

(73) Assignees: SINTOKOGIO, LTD., Aichi (JP); FUJIWA DENKI CO., LTD., Aichi (JP)

( * ) Notice: Subject to any disclaimer, the term of this patent is extended or adjusted under 35 U.S.C. 154(b) by 228 days.

(21) Appl. No.: 15/552,406

(22) PCT Filed: Mar. 4, 2015

(86) PCT No.: PCT/JP2015/056358

§ 371 (c)(1),
(2) Date: Aug. 21, 2017

(87) PCT Pub. No.: WO2016/139776

PCT Pub. Date: Sep. 9, 2016

(65) Prior Publication Data

US 2018/0021852 A1 Jan. 25, 2018

(51) Int. Cl.
*B22D 39/04* (2006.01)
*B22D 41/12* (2006.01)

(52) U.S. Cl.
CPC ..... *B22D 41/12* (2013.01)

(58) Field of Classification Search
CPC ..... B22D 39/04; B22D 37/00; B22D 41/06
See application file for complete search history.

(56) References Cited

U.S. PATENT DOCUMENTS 8,644,977 B2 * 2/2014 Adachi ..... B22D 35/04 700/146
9,289,825 B2 * 3/2016 Terada ..... B22D 41/06
(Continued)

FOREIGN PATENT DOCUMENTS

CN 101811187 A 8/2010
CN 102015162 A 4/2011
(Continued)

OTHER PUBLICATIONS

International Search Report issued by the Japan Patent Office in corresponding International Application No. PCT/JP2015/056358, dated May 19, 2015 (1 page).
(Continued)

*Primary Examiner* — Scott R Kastler
(74) *Attorney, Agent, or Firm* — Finnegan, Henderson, Farabow, Garrett & Dunner, LLP

(57) ABSTRACT

A system and a method for automatically transporting molten metal are provided to produce a cast product with stable qualities. The system (1) for transporting molten metal from a furnace (F) to a pouring machine (100) comprises a ladle (10) for reaction, a device (50) for feeding an alloyed metal, a ladle (60) for pouring, a bogie (20) for receiving molten metal, and a bogie (70) for transporting the ladle for pouring, and a pouring machine (100). The bogie for receiving molten metal has a controller for it. The bogie for receiving molten metal has a controller for it. At least two of the controllers among the controller for the pouring machine, the controller for the device for feeding an alloyed metal, the controller for the bogie for receiving molten metal, and the controller for the bogie for transporting the ladle for pouring, are linked for the data communication.

16 Claims, 9 Drawing Sheets

(56) References Cited

U.S. PATENT DOCUMENTS

| | | | | |
|---|---|---|---|---|
| 2010/0324719 | A1 | 12/2010 | Ota et al. | |
| 2012/0043706 | A1 | 2/2012 | Tamotsu | |
| 2012/0150329 | A1 | 6/2012 | Hyoudo et al. | |
| 2018/0029116 | A1 * | 2/2018 | Nishida | B22D 37/00 |

FOREIGN PATENT DOCUMENTS

| | | | |
|---|---|---|---|
| EP | 2 444 179 | A1 | 4/2012 |
| JP | 2009-297783 | | 12/2009 |
| JP | 2012-525977 | | 10/2012 |
| WO | WO 2010/146908 | A1 | 12/2010 |

OTHER PUBLICATIONS

Supplementary European Search Report issued by the European Patent Office in corresponding Application No. EP 15883943.1, dated Oct. 23, 2018.

* cited by examiner

SYSTEM AND METHOD FOR TRANSPORTING MOLTEN METAL

This application is a U.S. National Phase of international Application No. PCT/JP2015/056358, filed Mar. 4, 2015, the content of which is incorporated herein by reference.

TECHNICAL FIELD

The present invention relates to a system and a method for transporting molten metal from a furnace to a mold in a foundry. Specifically, it relates to a system and a method that are suitable to add an alloyed metal to molten metal.

BACKGROUND ART

In a foundry, molten metal that has been melted in a furnace, etc., and that is hot, is transported to a pouring machine. It is poured into a mold by the pouring machine so that a product is cast. Depending on the property of the cast iron to be produced, an alloyed metal, such as Mg, Ce, Ca, Ni, Cr, Cu, Mo, V, or Ti, may be added to the molten metal to improve the strength and toughness, corrosion-resistance, heat-resistance, or abrasion-resistance. Generally, the alloyed metal is preliminarily put in a ladle that is to receive molten metal from the furnace so that it reacts with the molten metal that is poured into the ladle. Here, both molten metal that has not yet reacted with the alloyed metal, i.e., that is melted in a furnace, etc., and molten metal that has reacted with the alloyed metal, are just called "molten metal."

The reaction of the molten metal with the alloyed metal is usually violent. To improve the yield, the depth of the ladle should be 1.5 to 2.0 times its diameter. Thus a ladle for a reaction (hereafter, "ladle for reaction") that is deep and that has a pocket to store an alloyed metal is used. Further, it is transported into a room for a reaction to diminish the effects of the reaction on the environment. The molten metal that has reacted is transferred from the ladle for reaction to a ladle for pouring by means of a crane, etc., so that it is transported to a pouring machine that pours the molten metal into a mold. Thus such a ladle for reaction is also called a ladle for transferring. Transporting hot molten metal by means of a crane, etc., and transferring it from the ladle for reaction to the ladle for pouring require dangerous operations.

Therefore, a line for transporting molten metal has been proposed, wherein the molten metal is transported and transferred (see Japanese Patent No. 5475004). It comprises a bogie for transporting and transferring the molten metal that transports the ladle for receiving the molten metal on a track, a means for moving the ladle in the direction that is perpendicular to the track, a mechanism for vertically moving the ladle on the means for moving the ladle, a means for tilting the ladle that is provided on the mechanism for vertically moving the ladle, and a device for holding the ladle that is tilted by means of the means for tilting the ladle and that releasably holds the ladle for receiving the molten metal.

For example, to produce ductile cast-iron a spheroidizing element, such as Mg, Ce, or Ca, which is the alloyed metal, is added to the molten metal. The spheroidizing element is depleted over time, since it reacts with refractory materials of the ladle or air. Namely, fading of the spheroidizing element (below, simply called "fading") occurs. The fading is a phenomenon where the effect of a graphite-spheroidizing agent fades over time after the agent is added to the molten metal. Typically, it fades 20 minutes after it is added. If the effect fades, spheroidizing may become poor. Thus pouring the molten metal into a mold must be completed before poor spheroidizing by fading occurs.

Conventionally, the time for fading has been calculated by a skilled person so that poor sphedoidizing is prevented. However, the time for fading depends on the kind and the amount of the alloyed metal. Further, it may also depend on the size of a ladle for reaction and the method for transporting the ladle (the vibration of the ladle for reaction). The alloyed metal that has been manually measured is put into the pocket of the ladle for reaction by an operator. The operator causes the ladle for reaction to be quickly transported to the front of the furnace, causes the molten metal to be received by the ladle to spheroidize it, and causes the molten metal to be transferred to the ladle for pouring. By this way, the operator must work near the ladle for reaction that contains the molten metal. Thus problems in the working environment and safety have been pointed out.

As discussed above, in the foundry the following device or equipment may be installed: 1) equipment for melting, such as a furnace, 2) a device for feeding an alloyed metal, 3) a machine for pouring molten metal into a mold, 4) equipment for transporting the ladle for reaction among the position of the device for feeding an alloyed metal, the position of the furnace, the position of the room for a reaction, and the position for transferring the molten metal to the ladle for pouring, and 5) equipment for transporting the ladle for pouring between the position for transferring the molten metal from the ladle for reaction and the position of the machine for pouring molten metal into a mold. Since the foundry is wide and each of the devices and the equipment may be replaced individually, the controllers are installed for the respective devices and equipment. However, for example, although fading starts in the ladle for reaction, the effects of the fading must be considered at the operation for pouring the molten metal in the ladle for pouring into a mold.

The present invention aims to provide a system and a method for transporting molten metal to automatically feed an alloyed metal to a ladle for reaction and to automatically transport molten metal from the ladle for reaction to the pouring machine so as to safely produce a cast product that has stable qualities.

DISCLOSURE OF INVENTION

A system for transporting molten metal of the first aspect of the present invention is, for example, as in FIGS. 1 and 5, the system 1 for transporting molten metal that transports the molten metal from a furnace F to a pouring machine 100. It comprises a ladle 10 for reaction that receives molten metal from the furnace F so as to transfer the molten metal to a ladle 60 for pouring. It also comprises a device 50 for feeding an alloyed metal that feeds an alloyed metal to the ladle 10 for reaction. It also comprises the ladle 60 for pouring that receives the molten metal from the ladle 10 for reaction and that transports the molten metal to the pouring machine 100. It also comprises a bogie 20 for receiving molten metal that has a mechanism for transferring. The bogie 20 moves the ladle 10 for reaction among a position P2 for feeding the alloyed metal where the device 50 for feeding an alloyed metal puts the alloyed metal in the ladle 10 for reaction, a position P1 for receiving the molten metal where the ladle 10 for reaction receives the molten metal from the furnace F, and a position P4 for transferring the molten metal where the ladle 10 for reaction transfers the molten metal to the ladle 60 for pouring. The system 1 for transporting molten metal also comprises a bogie 70 for transporting the ladle for pouring that moves the ladle 60 for pouring from the position P4 for transferring the molten metal so as to transfer the ladle 60 for pouring to the pouring machine 100. It also comprises the pouring machine 100 that receives the ladle 60 for pouring from the bogie 70 for transporting the ladle for pouring and that pours the molten metal into a mold D. The pouring machine 100 has a controller 140 for controlling the pouring machine 100. The device 50 for feeding an alloyed metal has a controller 120 for controlling the device 50 for feeding an alloyed metal. The bogie 20 for receiving molten metal that has a mechanism for transferring has a controller 110 for controlling the bogie 20 for receiving molten metal that has a mechanism for transferring. The bogie 70 for transporting the ladle for pouring has a controller 130 for controlling the bogie 70 for transporting the ladle for pouring. At least two of the controllers among the controller 140 for the pouring machine, the controller 120 for the device for feeding an alloyed metal, the controller 110 for the bogie for receiving molten metal that has a mechanism for transferring, and the controller 130 for the bogie for transporting the ladle for pouring, are linked for data communication.

By this configuration, since the bogie for receiving molten metal that has a mechanism for transferring transports the ladle for reaction, an alloyed metal can be put in the ladle for reaction by the device for feeding an alloyed metal, molten metal from the furnace can be received by the ladle for reaction, and the molten metal in the ladle for reaction can be transferred to the pouring machine. Since the controllers are linked for the data communication, for example, the time for fading can be accurately measured to avoid poor spheroidizing. Thus the alloyed metal can be fed without manual operations. The molten metal can be safely and quickly transported from the ladle for reaction to the pouring machine and can be poured into a mold while the qualities are monitored.

By the system for transporting molten metal of the second aspect of the present invention, for example, as in FIGS. 1 and 5, in the system 1 for transporting molten metal of the first aspect the bogie 20 for receiving molten metal that has a mechanism for transferring has a first weighing scale 112 that weighs the ladle 10 for reaction. The data on the weight of the ladle 10 for reaction that has been measured by the first weighing scale 112 is transmitted to the controller 110 for the bogie for receiving molten metal that has a mechanism for transferring. The pouring machine 100 has a second weighing scale 142 that weighs the ladle 60 for pouring. The data on the weight of the ladle 60 for pouring that has been measured by the second weighing scale 142 is transmitted to the controller 140 for the pouring machine. The controller 110 for the bogie for receiving molten metal that has a mechanism for transferring receives, as first data W1 of information on weight, data on the weight of the molten metal in the ladle 10 for reaction when the molten metal from the furnace F has been received by the ladle 10 for reaction. The controller 140 for the pouring machine receives, as second data W2 of information on weight, data on the weight of the molten metal in the ladle 60 for pouring, which molten metal has been transferred from the ladle 10 for reaction. It further receives the first data W1 of information on weight from the controller 110 for the bogie for receiving molten metal that has a mechanism for transferring. It generates an error signal when the difference between the first data W1 of information on weight and the second data W2 of information on weight exceeds a predetermined first threshold.

By this configuration, the amount of molten metal can be measured that has spilled or leaked during the transportation from the ladle for reaction to the pouring machine. An error signal can be generated if the reduced amount of the molten metal exceeds a threshold. Thus that the molten metal is safely and definitely transported can be checked.

By the system for transporting molten metal of the third aspect of the present invention, for example, as in FIGS. 1 and 5, in the system 1 for transporting molten metal of the second aspect the alloyed metal includes magnesium. The controller 110 for the bogie for receiving molten metal that has a mechanism for transferring detects a start of fading in the ladle 10 for reaction by means of a variation of the weight that is measured by the first weighing scale 112.

By this configuration, the start of fading is automatically detected, so that no operator must watch the ladle for reaction, which is nearby. Thus the operation is safe and the start of fading is correctly detected.

By the system for transporting molten metal of the fourth aspect of the present invention, for example, as in FIGS. 1 and 5, in the system 1 for transporting molten metal of the third aspect, when the start of fading is detected the controller 110 for the bogie for receiving molten metal that has a mechanism for transferring sends a fading-started signal to indicate that fading has started or sends a fading-time signal that is an elapsed time calculated from the start of fading, to another controller 130, 140, 150, 160.

By this configuration, the time that has elapsed from the start of fading, which is automatically detected, can be monitored so that the time from the start of fading is correctly assessed.

By the system for transporting molten metal of the fifth aspect of the present invention, for example, as in FIGS. 1 and 5, in the system 1 for transporting molten metal of the fourth aspect the controller 140 for the pouring machine generates an error signal if the time TF that is calculated from the fading-started signal or the elapsed time TF from the start of fading that is received from any other controller exceeds a second threshold T2 before the weight of the molten metal in the ladle 60 for pouring becomes less than a predetermined weight.

By this configuration, that no time to generate poor spheroidizing has elapsed can be checked, based on the correct elapsed time from the start of fading, so as to prevent poor spheroidizing by fading.

By the system for transporting molten metal of the sixth aspect of the present invention, for example, as in FIGS. 1, 3, and 5, in the system 1 for transporting molten metal of any of the first to fifth aspects the device 50 for feeding an alloyed metal has a hopper 56 for weighing that stores an alloyed metal to be put into the ladle 10 for reaction and a third weighing scale 122 that measures the weight of the alloyed metal in the hopper 56 for weighing. Data on the weight of the alloyed metal that is measured by means of the third weighing scale 122 is transmitted to the controller 120 for the device for feeding an alloyed metal as third data W3 of information on weight. The controller 120 for the device for feeding an alloyed metal transmits the third data W3 of information on weight to the controller 110 for the bogie for receiving molten metal that has a mechanism for transferring. The first weighing scale 112 measures the weight of the alloyed metal that is put into the ladle 10 for reaction to transmit the data on the weight to the controller 110 for the bogie for receiving molten metal that has a mechanism for transferring as fourth data W4 of information on weight. The controller 110 for the bogie for receiving molten metal that has a mechanism for transferring generates an error signal if a difference between the third data W3 of information on weight and the fourth data W4 of information on weight exceeds a predetermined third threshold T3.

By this configuration, since the difference between the weight of the alloyed metal that is fed by the device for feeding an alloyed metal and the weight of the alloyed metal that is put into the ladle for reaction is obtained, the weight of the alloyed metal that has not been put from the device for feeding an alloyed metal into the ladle for reaction can be known. If that weight exceeds the predetermined third threshold, an error signal is generated. Thus the weight of the alloyed metal can be checked to see if the correct weight is put in the ladle for reaction.

By the system for transporting molten metal of the seventh aspect of the present invention, for example, as in FIG. 5, in the system 1 for transporting molten metal of any of the first to sixth aspects the first weighing scale 112 measures a weight of the ladle 10 for reaction before the alloyed metal is put in the ladle for reaction, to transmit the data on weight to the controller 110 for the bogie for receiving molten metal that has a mechanism for transferring as fifth data W5 of information on weight. The first weighing scale 112 measures the weight of the ladle 10 for reaction after the molten metal is transferred to the ladle 60 for pouring, to transmit the data on weight to the controller 110 for the bogie for receiving molten metal that has a mechanism for transferring as sixth data W6 of information on weight. The controller 110 for the bogie for receiving molten metal that has a mechanism for transferring generates an error signal if a difference between the fifth data W5 of information on weight and the sixth data W6 of information on weight exceeds a predetermined fourth threshold T4.

By this configuration, molten metal that contains an insufficient alloyed metal because of a shortage of a solution of the alloyed metal is prevented from being poured into a mold.

The system for transporting molten metal of the eighth aspect of the present invention further comprises, for example, as in FIG. 1, in the system 1 for transporting molten metal of any of the first to seventh aspects a device 80 for inoculating while transferring the molten metal. The device 80 inoculates the molten metal with an inoculant, which molten metal is being transferred from the ladle 10 for reaction to the ladle 60 for pouring.

By this configuration, since the molten metal can be inoculated with an inoculant while the molten metal is being transferred from the ladle for reaction to the ladle for pouring, an inoculant can be uniformly mixed with the molten metal in a short time.

By the system for transporting molten metal of the ninth aspect of the present invention, for example, as in FIG. 1, in the system 1 for transporting molten metal of any of the first to eighth aspects at least two of the positions among the position P2 for feeding the alloyed metal, the position P1 for receiving the molten metal, and the position P4 for transferring the molten metal where the bogie 20 for receiving molten metal that has a mechanism for transferring travels, are the same.

By this configuration, the advantageous effects that are obtained by the system for transporting molten metal of any of the first to eighth aspects can be obtained.

By the system for transporting molten metal of the tenth aspect of the present invention, for example, as in FIG. 6, in the system 1 for transporting molten metal of any of the first to ninth aspects the bogie 20 for receiving molten metal that has a mechanism for transferring has a device 40 for tilting that supports and tilts the ladle 10 for reaction so as to transfer the molten metal from the ladle 10 for reaction to the ladle 60 for pouring.

By this configuration, since the bogie for receiving molten metal that has a mechanism for transferring has the device for tilting, the molten metal can be automatically and safely transferred from the ladle for reaction to the ladle for pouring.

By the system for transporting molten metal of the eleventh aspect of the present invention, for example, as in FIG. 7, in the system 1 for transporting molten metal of the tenth aspect the bogie 20 for receiving molten metal that has a mechanism for transferring has a body 24 of the bogie that has wheels 22 to travel on a track R1 and a pantagraph-type device 28 for vertically moving a table, which device 28 is provided on the body 24 of the bogie and vertically moves the device 40 for tilting by means of a pantagraph.

By this configuration, since the bogie for receiving molten metal that has a mechanism for transferring has the pantagraph-type device for vertically moving the table to vertically move the device for tilting, the molten metal can be automatically and safely transferred from the ladle for reaction to the ladle for pouring. Further, even if the elevation of the ladle for reaction differs from that of the ladle for pouring, the molten metal can still be easily transferred.

By the system for transporting molten metal of the twelfth aspect of the present invention, for example, as in FIG. 6, in the system 1 for transporting molten metal of the tenth aspect the bogie 20 for receiving molten metal that has a mechanism for transferring has a body 24 of the bogie that has wheels 22 to travel on a track R1, guiding columns 32 that are provided on the body 24 of the bogie, a vertically-moving table 34 that horizontally extends from the guiding columns 32, that vertically moves above the bogie 20, and that mounts the device 40 for tilting thereon, and a device 36 for vertically moving the table 34.

By this configuration, since the bogie for receiving molten metal that has a mechanism for transferring has the vertically-moving table, on which the device for tilting is mounted, to vertically move the device for tilting, the molten metal can be automatically and safely transferred from the ladle for reaction to the ladle for pouring. Further, even if the elevation of the ladle for reaction differs from that of the ladle for pouring, the molten metal can still be easily transferred.

By the system for transporting molten metal of the thirteenth aspect of the present invention, for example, as in FIG. 8, in the system 1 for transporting molten metal of the tenth aspect the bogie 20 for receiving molten metal that has a mechanism for transferring has a body 24 of the bogie that has wheels 22 to travel on a track R1 and a roller conveyor 41 that is provided on the body 24 of the bogie and that moves the ladle 10 for reaction. The device 40 for tilting has a shaft 42 for transferring the molten metal, which shaft holds the ladle 10 for reaction at a center line to tilt the ladle for reaction, a sector gear 44 that is connected to the ladle 10 for reaction at a position that is different from the center line, to tilt the ladle for reaction, and a driver 46 for driving the sector gear 44.

By this configuration, since the bogie for receiving molten metal that has a mechanism for transferring has the roller conveyor that moves the ladle for reaction and the device for tilting has the sector gear and the driver for the sector gear, molten metal can be automatically and safely transferred from the ladle for reaction to the ladle for pouring.

By the system for transporting molten metal of the fourteenth aspect of the present invention, for example, as in FIGS. 3 and 4, in the system 1 for transporting molten metal of the sixth aspect the device 50 for feeding an alloyed metal has a plurality of hoppers 54 that store the alloyed metal, a plurality of hoppers 56 for weighing that feed a predetermined amount of the alloyed metal from the plurality of the hoppers 54 to a chute 52, a plurality of the third weighing scales 122, and a plurality of gates 58 that supply the alloyed metal that has been measured by the hoppers 56 for weighing to the chute 52. The third data of information on weight is the sum of the weights that are measured by the respective third weighing scales.

By this configuration, since the predetermined amount of the alloyed metal can be measured by the hoppers for weighing to be fed to the ladle for reaction through the chute, a predetermined amount of the alloyed metal can be quickly prepared and an exact amount of it can be put in the ladle for reaction. Further, since the alloyed metal can be fed from the plurality of the hoppers, multiple kinds of the alloyed metal can be fed at exact amounts.

A method for transporting molten metal of the fifteenth aspect of the present invention is, for example, as in FIG. 1, the method for transporting molten metal from a furnace F to a pouring machine 100. It comprises the step of transporting a ladle 10 for reaction that receives molten metal from the furnace F and that transfers the molten metal to a ladle 60 for pouring to a position P2 for feeding an alloyed metal, where the alloyed metal is put in the ladle 10 for reaction. It also comprises the step of putting the alloyed metal in the ladle 10 for reaction. It also comprises the step of transporting the ladle 10 for reaction in which the alloyed metal has been put in to a position P1 for receiving the molten metal from the furnace F. It also comprises the step of causing the ladle 10 for reaction to receive molten metal from the furnace F, which ladle 10 for reaction has been transported to the position P1 for receiving the molten metal. It also comprises the step of transporting the ladle 10 for reaction that has received the molten metal to a position P4 for transferring the molten metal where the molten metal is transferred to the ladle 60 for pouring. It also comprises the step of transferring the molten metal from the ladle 10 for reaction, which has been transported to the position P4 for transferring the molten metal, to the ladle 60 for pouring. A first difference in the weights is calculated by using a weight of the molten metal that has been transferred from the ladle 10 for reaction to the ladle 60 for pouring by weighing the ladle 10 for reaction and using a weight of the molten metal that has been transferred to the ladle 60 for pouring by weighing the ladle 60 for pouring. The method further comprises the step of generating an error signal if the first difference in the weights exceeds a first threshold T1. Incidentally, the method may further comprise the step of transporting the ladle 60 for pouring, to which the molten metal has been transferred from the ladle 10 for reaction, to the pouring machine 100. It may also comprise the step of pouring the molten metal from the ladle 60 for pouring into a mold D.

By this configuration, since the difference between the weight of the molten metal that has been transferred to the ladle for pouring by weighing the ladle for reaction and the weight of the molten metal that has been transferred to the ladle for pouring by weighing the ladle for pouring is known, an amount of the molten metal can be measured that has spilled or leaked during the transportation from the ladle for reaction to the ladle for pouring at the pouring machine, so that an error signal is generated if the reduced amount of the molten metal exceeds the threshold. Thus that the molten metal is safely and definitely transported can be checked.

The method for transporting molten metal of the sixteenth aspect of the present invention further comprises, for example, as in FIG. 1, in the method for transporting molten metal of the fifteenth aspect, the step of weighing the ladle 10 for reaction that has received the molten metal from the furnace F to detect a start of fading based on a variation of the weight and calculating an elapsed time from the start of fading. It also comprises the step of generating an error signal if the elapsed time TF from the start of fading exceeds a predetermined second threshold T2 before the weight of the molten metal in the ladle 60 for pouring after having poured the molten metal 10 into a mold becomes less than a predetermined weight.

By this configuration, that no time has elapsed can be checked, based on the exact elapsed time for fading, so that any possible poor spheroidizing that might be caused by fading can be prevented.

The method for transporting molten metal of the seventeenth aspect of the present invention further comprises, for example, as in FIG. 1, in the method for transporting molten metal of the fifteenth or sixteenth aspect, the step of calculating a second difference in the weights based on a weight of the alloyed metal that is to be put in the ladle 10 for reaction and a weight of the alloyed metal that has been put in the ladle 10 for reaction by weighing the ladle 10 for reaction and of generating an error signal if the second difference in the weights exceeds a third threshold T3.

By this configuration, since the difference between the weight of the alloyed metal that is to be put in the ladle for reaction and the weight of the alloyed metal that has been put in the ladle for reaction can be checked, the weight of the alloyed metal that has not been put in the ladle for reaction is known. Further, since the error signal is generated if that weight exceeds the predetermined third threshold, that the correct amount of the alloyed metal is put in the ladle can be checked.

By the method for transporting molten metal of the eighteenth aspect of the present invention, for example, as in FIG. 1, in the method for transporting molten metal of any of the fifteenth to seventeenth aspects at least two of the position P2 for feeding the alloyed metal, the position P4 for transferring the molten metal, and the position P1 for receiving the molten metal, are the same, so that in the step of transporting the ladle 10 for reaction the ladle for reaction is not transported between the same positions.

By this configuration, the advantageous effects that are obtained by any of the fifteenth to seventeenth aspects can be obtained.

A system for transporting molten metal of the nineteenth aspect of the present invention is, for example, as in FIGS. 1 and 5, the system 1 for transporting molten metal that transports the molten metal from a furnace F to a pouring machine 100. It comprises a ladle 10 for reaction that receives molten metal from the furnace F so as to transfer the molten metal to a ladle 60 for pouring. It also comprises a device 50 for feeding an alloyed metal that feeds an alloyed metal to the ladle 10 for reaction. It also comprises the ladle 60 for pouring that receives the molten metal from the ladle 10 for reaction and that pours the molten metal into a mold D. It also comprises a bogie 20 for receiving molten metal that has a mechanism for transferring. The bogie 20 moves the ladle 10 for reaction among a position P2 for feeding the alloyed metal where the device 50 for feeding an alloyed metal puts the alloyed metal in the ladle 10 for reaction, a position P1 for receiving the molten metal where the ladle 10 for reaction receives the molten metal from the furnace F, and a position P4 for transferring the molten metal where the ladle 10 for reaction transfers the molten metal to the ladle 60 for pouring. The system 1 for transporting molten metal also comprises a pouring machine 100 that pours the molten metal in the ladle 60 for pouring into the mold D. The pouring machine 100 has a controller 140 for controlling the pouring machine 100. The bogie 20 for receiving molten metal that has a mechanism for transferring has a controller 110 for controlling the bogie 20 for receiving molten metal that has a mechanism for transferring. The controller 140 for controlling the pouring machine and the controller 110 for controlling the bogie for receiving molten metal are linked for data communication.

By this configuration, since the bogie for receiving molten metal that has a mechanism for transferring transports the ladle for reaction, an alloyed metal can be put in the ladle for reaction by the device for feeding an alloyed metal, molten metal from the furnace can be received by the ladle for reaction, and the molten metal in the ladle for reaction can be transferred to the pouring machine. Since the controller for the pouring machine and the controller for the bogie for receiving molten metal are linked for the data communication, for example, the time for fading can be accurately measured, to avoid poor spheroidizing. Thus the alloyed metal can be fed without manual operations. The molten metal can be safely and quickly transported from the ladle for reaction to the pouring machine and can be poured into a mold while the qualities are monitored.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural form of a noun, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BRIEF DESCRIPTION OF DRAWINGS

FIG. 8(*b*) is a partial view of the sector gear 44. FIG. 8(*c*) illustrates the support for the rotation of the ladle, which support is provided on the ladle for reaction.

BEST MODE FOR CARRYING OUT THE INVENTION

Figure 1:
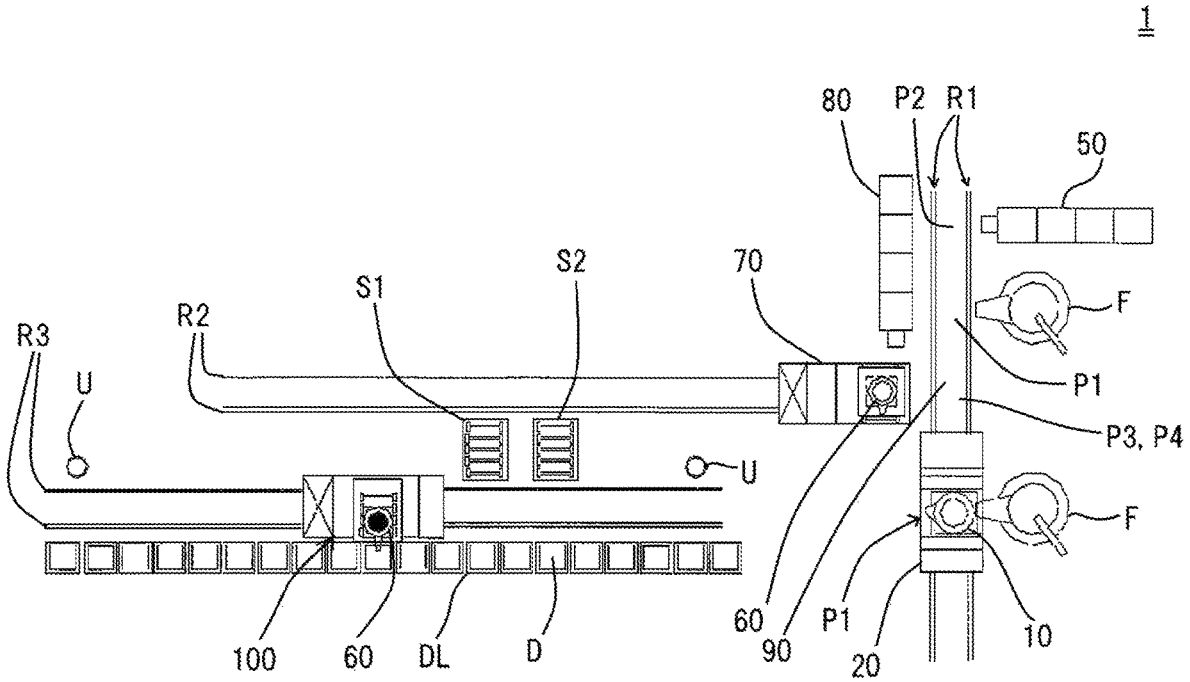
FIG. 1 is a plan view of the foundry that has the system for transporting molten metal, which is an embodiment of the present invention.

Below, system 1 for transporting molten metal of an embodiment of the present invention is discussed with reference to the appended drawings. In the drawings, the same numeral or symbol is used for the elements that correspond to, or are similar to, each other. Thus duplicate descriptions are omitted. FIG. 1 is a plan view of a foundry that has the system 1 for transporting molten metal, as an embodiment of the present invention. As in FIG. 1, the foundry has a melting furnace F that causes a ladle 10 for reaction to receive molten metal and a line DL of molds that transports a mold D to cool and solidify the molten metal so that a cast product is produced. Incidentally, the ladle 10 for reaction may receive molten metal from a holding furnace, etc., instead of the melting furnace. The foundry further has a system 1 for transporting molten metal that transports the ladle 10 for reaction from the melting furnace F to transfer the molten metal to a ladle 60 for pouring so that the molten metal is poured into a mold D by a pouring machine 100. The system 1 comprises the ladle 10 for reaction, a bogie 20 for receiving molten metal that has a mechanism for transferring, a device 50 for feeding an alloyed metal, the ladle 60 for pouring, a bogie 70 for transporting the ladle for pouring, and the pouring machine 100. It may further comprise a device 80 for inoculating while transferring the molten metal.

Figure 2:
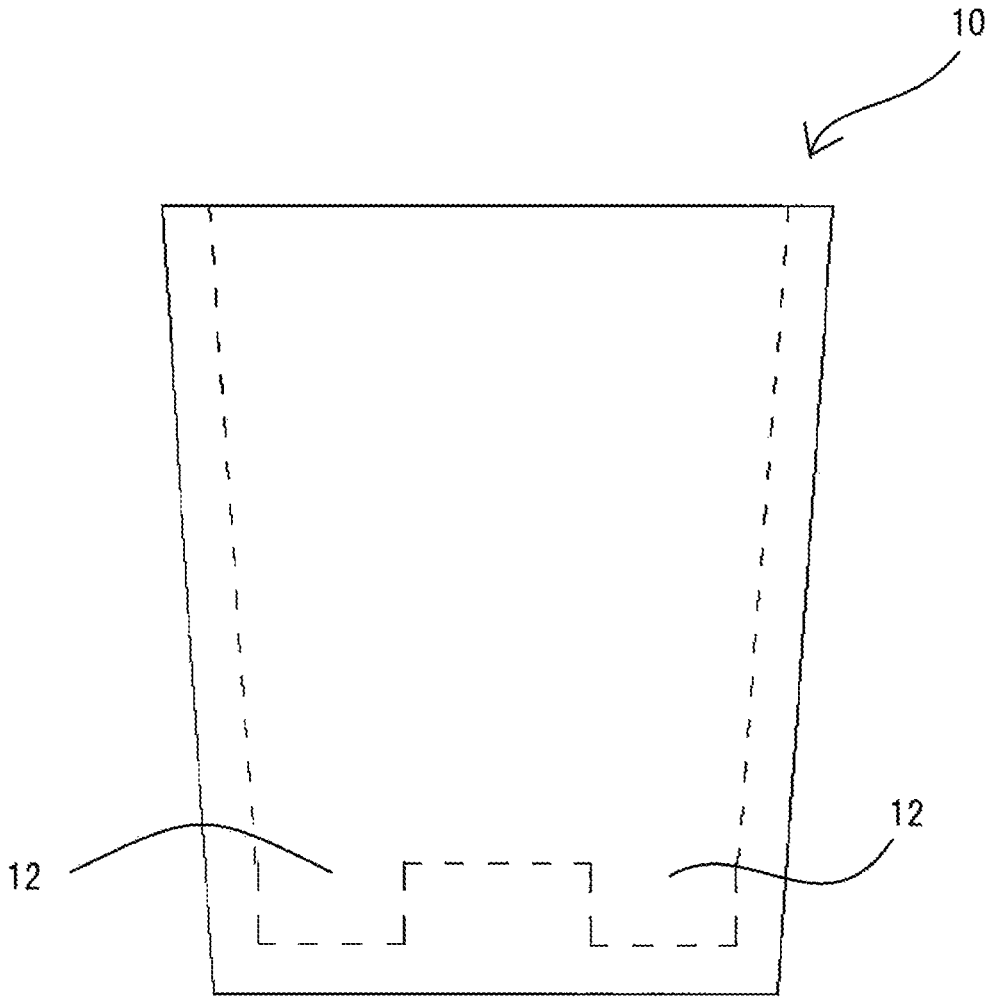
FIG. 2 is a side sectional view of an example of the ladle for reaction.

FIG. 2 is a side view of an example of the ladle 10 for reaction, which is used in the system 1 for transporting molten metal. In FIG. 2 the cross-section is shown by dotted lines. The ladle 10 for reaction is used for receiving molten metal from the furnace F and transferring it to the ladle 60 for pouring. A pocket 12 is formed on the bottom inside of it. It is an indentation for preliminarily setting an alloyed metal to react with the molten metal. Incidentally, no pocket 12 may be formed in the ladle 10 for reaction.

The ladle 10 for reaction is transported by means of the bogie 20 for receiving molten metal that has a mechanism for transferring among (1) a position P1 for receiving the molten metal from the furnace F, which position is in front of the melting furnace F, (2) a position P2 for feeding the alloyed metal from a device 50 for feeding an alloyed metal, which position is in front of the device 50, (3) a position P3 for a reaction where the alloyed metal reacts with the molten metal, and (4) a position P4 for transferring the molten metal from the ladle 10 for reaction to the ladle 60 for pouring. The details of the bogie 20 for receiving molten metal that has a mechanism for transferring are discussed below. A room 90 for a reaction is preferably provided at the position P3 for the reaction. The room 90 for a reaction has a ceiling above the ladle 10 for reaction. Since the ladle 10 for reaction is covered by that ceiling, any droplet of the molten metal can be prevented from scattering even if the droplet flies from the ladle 10 for reaction because of the reaction. A duct (not shown) may be connected to the room 90 for a reaction so that dust or gas that is generated by the reaction of the alloyed metal and the molten metal in the ladle 10 for reaction may be safely disposed of.

Figure 3:
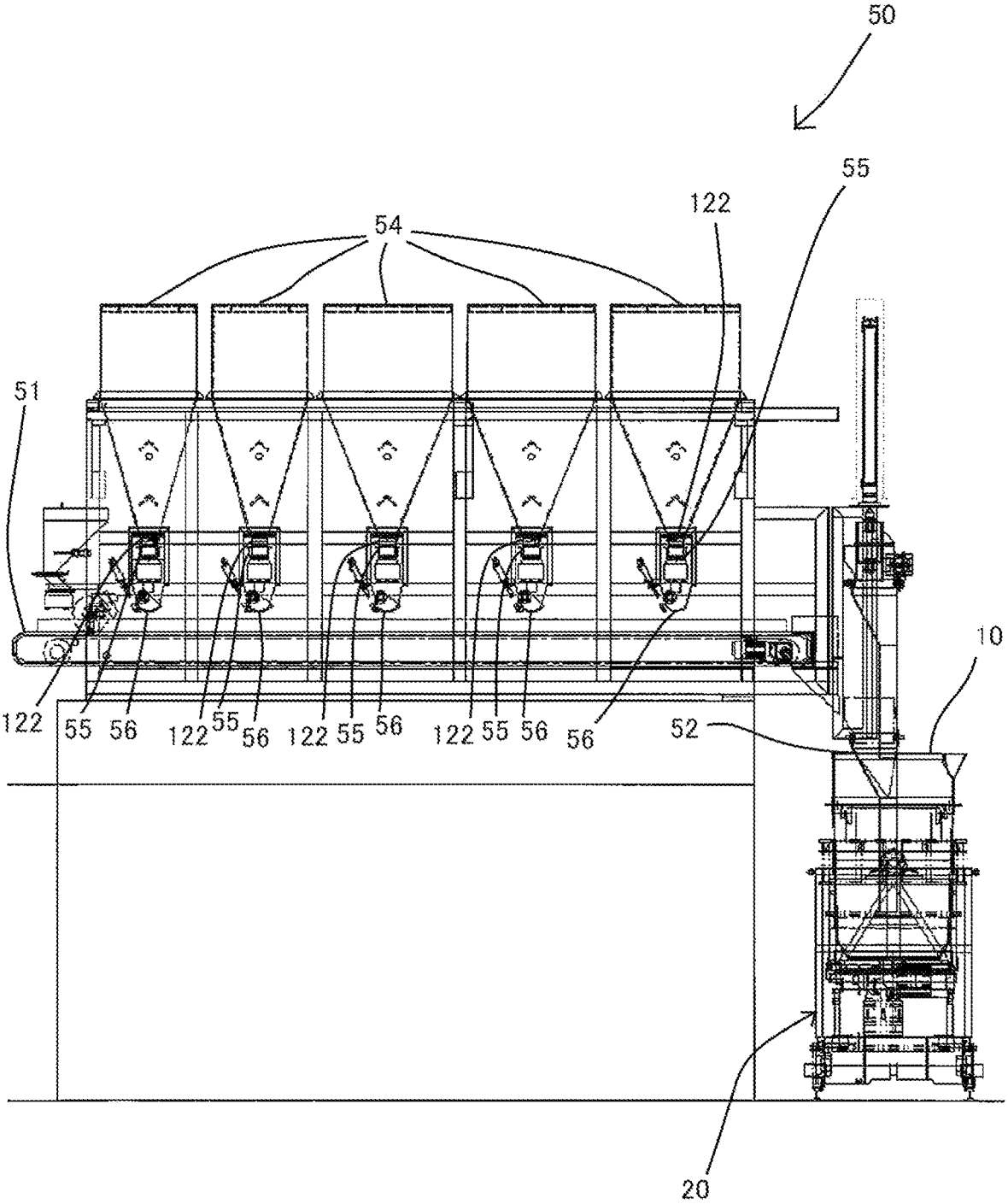
FIG. 3 is a side view of an example of the device for feeding an alloyed metal.

FIG. 3 is a side view of an exemplary structure of the device 50 for feeding an alloyed metal. The device 50 for feeding an alloyed metal feeds an alloyed metal to the ladle 10 for reaction, which alloyed metal is added to the molten metal. The alloyed metal may be a graphite-spheroidizing element, such as magnesium, cesium, or calcium. The device 50 for feeding an alloyed metal may feed an inoculant, such as calcium silicon, ferrosilicon, or graphite. Generally, as the reaction of a molten metal with an alloyed metal is violent, the alloyed metal is fed to the ladle 10 for reaction before the molten metal is poured. The alloyed metal is preferably put in the pocket 12 of the ladle 10 for reaction. Further, the alloyed metal in the pocket 12 is preferably covered with a covering agent so as to inhibit the reaction until a predetermined amount of the molten metal is poured into the ladle 10 for reaction. The covering agent may be any material that can prevent the alloyed metal from contacting the molten metal and that does not affect the product. It may be, but is not limited to, steel scrap, SiC, or whiskers. The device 50 for feeding an alloyed metal as in FIG. 3 has five hoppers 54 for storing alloyed metals. Thus five kinds of alloyed metals can be mixed and fed to the ladle 10 for reaction. There may be just one of the hoppers 54 and the number can be arbitrarily determined depending on the intended use.

Figure 4:
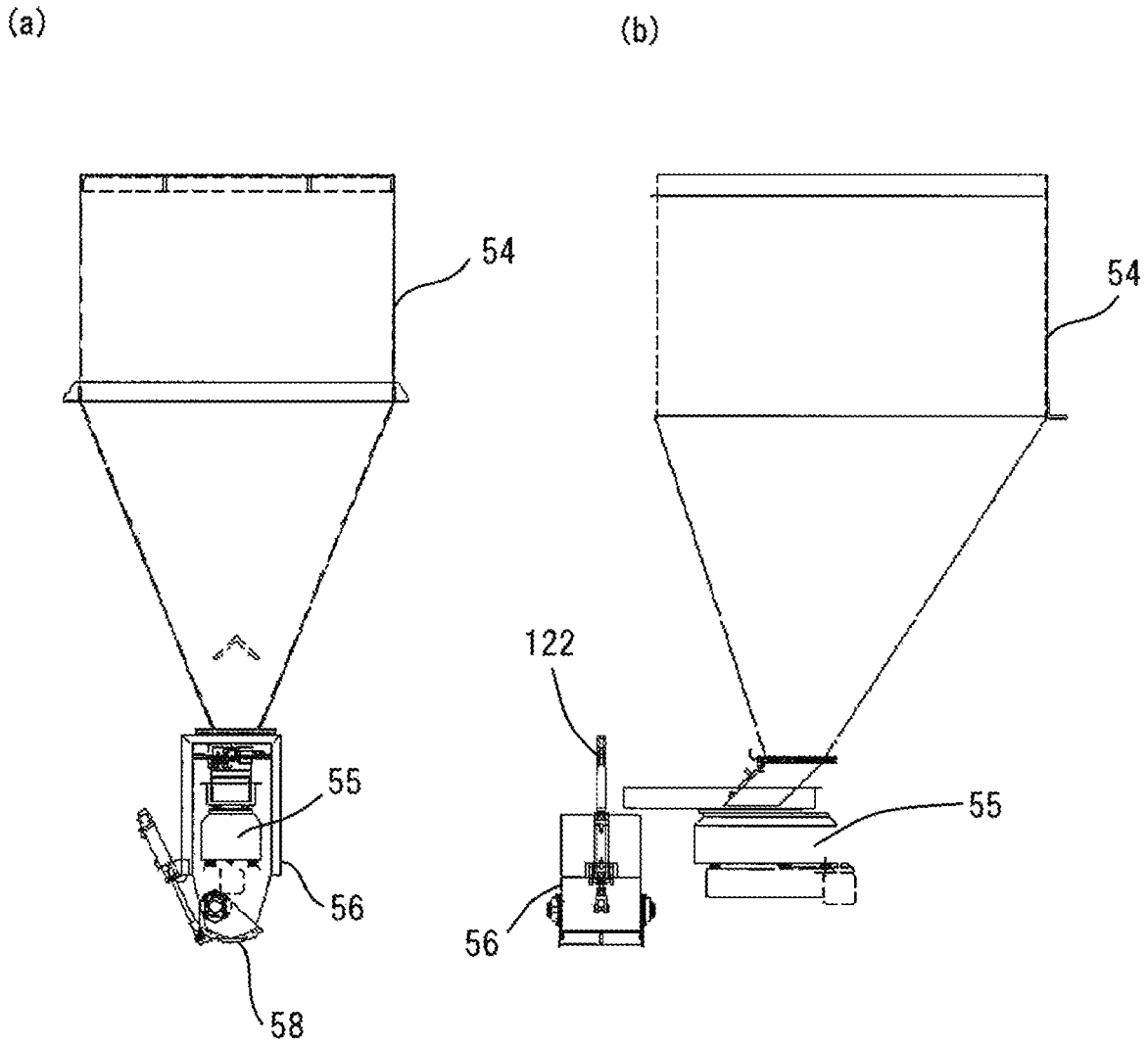
FIG. 4 is a structural view of the exit of the hopper. (a) is a side view and (b) is a front view.

Now, the details of the exits of the hoppers 54 are also discussed with reference to FIG. 4. FIG. 4 illustrates the detailed structures of the exits of the hoppers 54. FIGS. 4(*a*) and (*b*) are a side view and a front view, respectively. An electromagnetic feeder 55 is provided at the lower exit of each hopper 54. The electromagnetic feeder 55 feeds to a hopper 56 for weighing a predetermined amount of the alloyed metal that is stored in the hopper 54. A hopper 56 for weighing is provided below each hopper 54, to store the alloyed metal that is transported by the electromagnetic feeder 55. The bottom of the hopper 56 for weighing is shut by a gate 58. The weight of the alloyed metal that is stored in the hopper 56 for weighing is measured by a load cell 122, which is a third weighing scale. When the alloyed metal is to be fed, the gate 58 is opened so that the alloyed metal is fed to the ladle 10 for reaction through a chute 52. When multiple hoppers 54 are provided, the alloyed metal that has passed through the gates 58 may be transported by a conveyor belt 51 to the chute 52.

The ladle 60 for pouring receives the molten metal from the ladle 10 for reaction to pour it into a mold D. The ladle 60 is tilted by means of a pouring machine 100 to pour the molten metal into the mold D. Although the position P4 for transferring the molten metal is separated from the pouring machine 100 in FIG. 1, it may be the same position as that of the pouring machine 100. Namely, the molten metal in the ladle 10 for reaction may be transferred to the ladle 60 for pouring that is held by the pouring machine 100.

The device 80 for inoculating while transferring the molten metal feeds an inoculant while the molten metal is transferred from the ladle 10 for reaction to the ladle 60 for pouring. The configuration of the device 80 for inoculating while transferring the molten metal is generally the same as that of the device 50 for feeding an alloyed metal. By feeding an inoculant while the molten metal is transferred from the ladle 10 for reaction to the ladle 60 for pouring, the inoculant is quickly and uniformly mixed with the molten metal. Incidentally, an inoculant may be manually fed without the device 80 being provided. The device 80 can feed a proper amount of an inoculant based on the weight of the molten metal, i.e., the weight of the molten metal in the ladle 10. The weight of the molten metal in the ladle 10 may be changed. Since an inoculant is fed at the weight that is appropriate to the weight of the molten metal, a proper inoculation can be carried out.

In the system 1 for transporting molten metal as in FIG. 1, the ladle 60 for pouring is transported from the position P4 for transferring the molten metal to the pouring machine 100 by means of the bogie 70 for transporting the ladle for pouring. The bogie 70 has a bogie that travels on a rail R2 and a conveyor that moves the ladle 60 on the bogie, though they are not shown in the drawings. More specifically, a rail R3 for the pouring machine 100 is laid parallel to the rail R2 for the ladle 60. A conveyor S1 for the filled ladle and a conveyor S2 for the empty ladle are provided between the rail R2 and the rail R3 so that the ladle 60 on the bogie 70 that travels on the rail R2 is transferred to the pouring machine 100 that travels on the rail R3. The ladle 60 that stores the molten metal is transferred from the bogie 70 to the pouring machine 100 via the conveyor S1 for the filled ladle. The ladle 60 from which the molten metal has been poured into molds is transferred from the pouring machine 100 to the bogie 70 via the conveyor S2 for the empty ladle. The configuration of the bogie 70, the conveyor S1, or the conveyor S2 may be one that has been publicly known. Thus the discussion on the details of any such configuration is omitted.

The pouring machine 100 tilts the ladle 60 for pouring so that the molten metal in the ladle 60 is poured into each of the molds D. The molds D are lined up on the line DL of molds to repeat the steps of moving and stopping. While the molds D stop, the pouring machine 100 causes the molten metal to be poured from the ladle 60 into a mold. After the pouring to that mold is finished, the molds D move by a length of the mold D. The next mold D that is empty moves to the front of the pouring machine 100 and stops there. If the time required for the mold D to move is long, the pouring machine 100 may travel on the rail R3 while the molten metal is being poured into the mold D, and the mold D may move on the line DL of molds.

Figure 5:
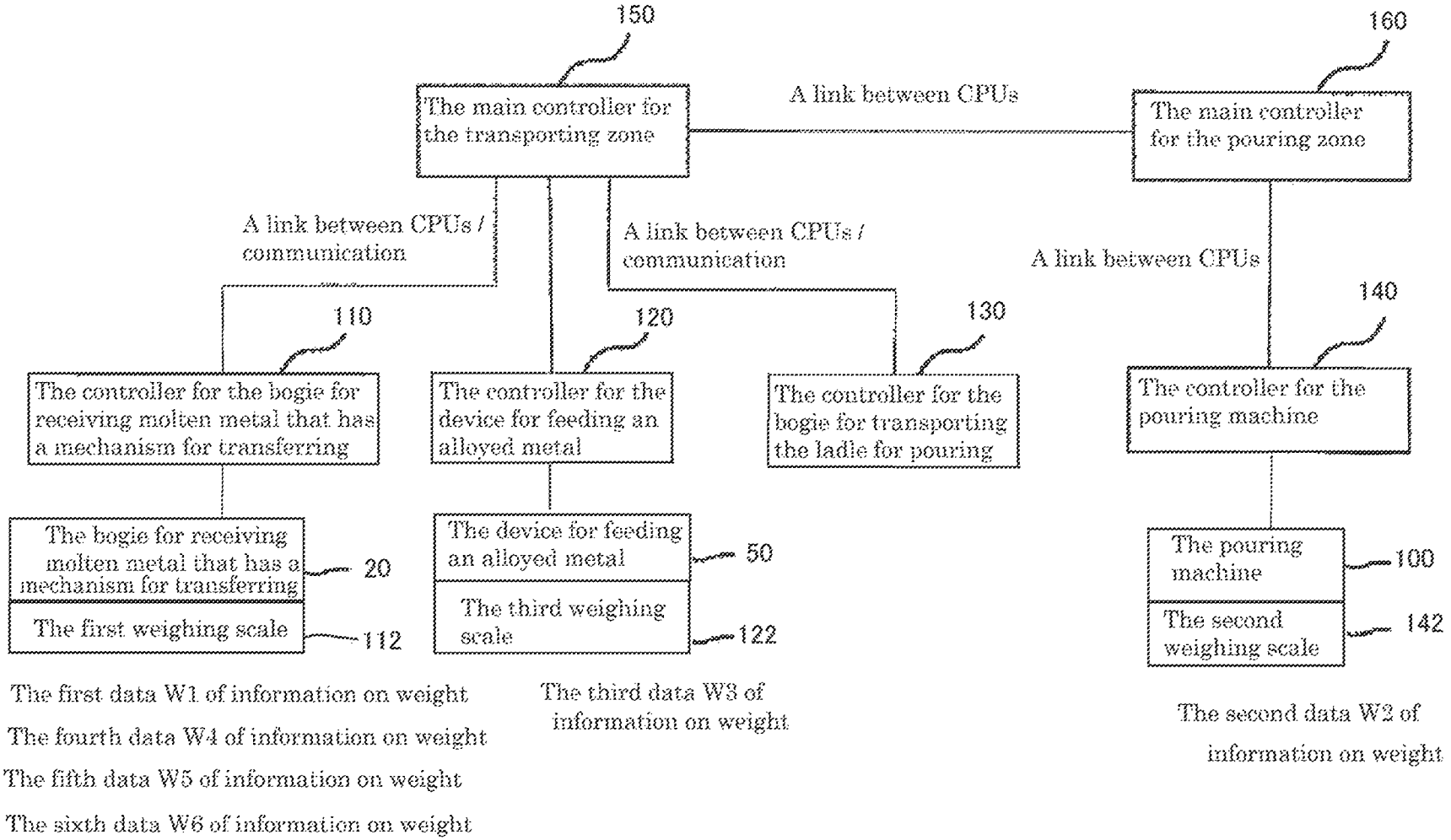
FIG. 5 is a schematic block diagram of an example of the control system for the system for transporting molten metal.

FIG. 5 is a block schematic diagram of an example of the control system for the system 1 for transporting molten metal. The bogie 20 for receiving molten metal that has a mechanism for transferring has a controller 110 for the bogie for receiving molten metal that has a mechanism for transferring. The controller 110 controls the travel of the bogie 20 and the functions for transferring molten metal. The device 50 for feeding an alloyed metal has a controller 120 for the device for feeding an alloyed metal. The controller 120 controls the functions of the device 50. The bogie 70 for transporting the ladle for pouring has a controller 130 for the bogie for transporting the ladle for pouring. The controller 130 controls the travel of the bogie 70 and the functions for transferring the ladle 60 for pouring. The pouring machine 100 has a controller 140 for the pouring machine. The controller 140 controls the travel of the pouring machine 100 and the functions for tilting the ladle 60, namely, pouring the molten metal into molds.

The controller 110 for the bogie for receiving molten metal that has a mechanism for transferring, the controller 120 for the device for feeding an alloyed metal, and the controller 130 for the bogie for transporting the ladle for pouring, are all connected to a main controller 150 for the transporting zone to communicate with each other. The controller 140 for the pouring machine is connected to a main controller 160 for the pouring zone so as to communicate with each other. The main controller 150 for the transporting zone is connected to the main controller 160 for the pouring zone so as to communicate with each other. That is, the controllers for the respective devices in the foundry, i.e., the controller 110 for the bogie for receiving molten metal that has a mechanism for transferring, the controller 120 for the device for feeding an alloyed metal, the controller 130 for the bogie for transporting the ladle for pouring, and the controller 140 for the pouring machine, are all connected so as to communicate with each other. Incidentally, the main controllers for the respective zones, i.e., the main controller 150 for the transporting zone and the main controller 160 for the pouring zone, may be connected to other controllers (not shown) for respective zones or to a controller (not shown) for controlling an entire foundry, so as to communicate with each other.

Neither main controller for the zone, i.e., the main controller 150 for the transporting zone or the main controller 160 for the pouring zone, may be provided, so that the controllers for the devices, i.e., the controller 110 for the bogie for receiving molten metal that has a mechanism for transferring, the controller 120 for the device for feeding an alloyed metal, the controller 130 for the bogie for transporting the ladle for pouring, and the controller 140 for the pouring machine, are directly connected so as to communicate with each other. The controllers 110, 120, 130, 140 for the devices may be connected to a controller for the entire foundry or any other controller (not shown) so as to communicate with each other.

The bogie 20 for receiving molten metal that has a mechanism for transferring has a first weighing scale 112 that measures the weight of the molten metal and the weight of the alloyed metal in the ladle 10 for reaction. The data on the weight that is measured by means of the first weighing scale 112 is first transmitted to the controller 110 for the bogie for receiving molten metal that has a mechanism for transferring. The load cell 122 of the device 50 for feeding an alloyed metal, which is the third weighing scale, measures the weight of the alloyed metal that passes through the chute 52 of the device 50. The data on the weight that is measured by means of the third weighing scale 122 is first transmitted to the controller 120 for the device for feeding an alloyed metal. The pouring machine 100 has a second weighing scale 142 that measures the weight of the molten metal in the ladle 60 for pouring. The data on the weight that is measured by means of the second weighing scale 142 is first transmitted to the controller 140 for the pouring machine.

The first weighing scale 112 first measures the weight of the alloyed metal that has been fed from the device 50 for feeding an alloyed metal into the pocket 12 of the ladle 10 for reaction to transmit the data on that weight, as a fourth data W4 of information on the weight, to the controller 110 for the bogie for receiving molten metal that has a mechanism for transferring. Incidentally, the alloyed metal is not necessarily fed into the pocket 12. Next, the first weighing scale 112 measures the weight of the molten metal that is received from the melting furnace F to transmit the data on that weight to the controller 110. The data on the weight of the molten metal and the alloyed metal (also called just "the weight of the molten metal") when receiving the molten metal is completed, as a first data W1 of information on the weight, is transmitted to the controller 110. The first weighing scale 112 continues to measure the weight of the molten metal and the alloyed metal to transmit the data on that weight to the controller 110.

The first weighing scale 112 may measure the weight of the ladle 10 for reaction before the alloyed metal is fed from the device 50 for feeding an alloyed metal into the pocket 12 of the ladle 10 for reaction to transmit the data on that weight, as a fifth data W5 of information on the weight, to the controller 110 for the bogie for receiving molten metal that has a mechanism for transferring. Further, it may measure the weight of the ladle 10 after the molten metal is transferred to the ladle 60 for pouring to transmit the data on that weight, as a sixth data W6 of information on the weight, to the controller 110. The difference between the sixth data W6 of information on the weight and the fifth data W5 of information on weight is the weight of the alloyed metal that has remained in the ladle 10 without been dissolved. If much of the alloyed metal were to remain, insufficient alloyed metal would be added to the molten metal. Thus, if the difference between the sixth data W6 and the fifth data W5 is greater than a fourth threshold T4, an error signal is generated. To act as the error signal, the controller 110 may sound an alarm or turn on an alarm lamp or may send an error signal to another controller. Further, the error signal is transmitted to the controller 130 for the bogie for transporting the ladle for pouring so as not to pour the molten metal into a mold from the ladle 60 for pouring that received that molten metal. In this way, using the fifth data W5 of information on the weight and the sixth data W6 of information on the weight, casting by using molten metal that contains insufficient alloyed metal can be prevented.

The second weighing scale 142 measures the weight of the molten metal in the ladle 60 for pouring after the molten metal is transferred from the ladle 10 for reaction to transmit the data on that weight, as a second data W2 of information on the weight, to the controller 140 for the pouring machine. It also measures the weight of the molten metal that remains in the ladle 60 for pouring while the molten metal is poured from the ladle 60 into the mold D. Namely, it measures the weight of the molten metal that has been poured into the mold D by the pouring machine 100.

The third weighing scale 122 measures the weight of the alloyed metal in the hopper 56 for weighing before it passes through the chute 52 for feeding of the device 50 for feeding an alloyed metal to transmit the data on that weight, as a third data W3 of information on the weight, to the controller 120 for the device for feeding an alloyed metal. The weight of the alloyed metal before passing through the chute 52 represents the weight of the alloyed metal that the device 50 feeds. If the device 50 has two or more hoppers 54, namely, multiple third weighing scales 122, then the sum of the weights of the alloyed metals that are measured by the third weighing scales 122 is transmitted to the controller 120, as the third data W3 of information on the weight.

The controller 110 for the bogie for receiving molten metal that has a mechanism for transferring controls the travel of the bogie 20 for receiving molten metal that has a mechanism for transferring. Namely, it causes the bogie 20 to move from the position P2 for feeding the alloyed metal to the position P1 for receiving the molten metal, and then to the position P3 for the reaction, and then to the position P4 for transferring the molten metal. At the position P4 it causes the bogie 20 to move the ladle 10 for reaction upwardly, and then to tilt it to transfer the molten metal to the ladle 60 for pouring. Then it causes the bogie 20 to move the ladle 10 downwardly and to move to the position P2. These operations are repeated.

The controller 110 for the bogie for receiving molten metal that has a mechanism for transferring receives the third data W3 of information on the weight, i.e., the weight of the alloyed metal that is fed by the device 50 for feeding an alloyed metal, from the controller 120 for the device for feeding an alloyed metal. If the alloyed metal is supplied by the hoppers 54, it receives the third data W3 of information on the weight, which is the sum of the weights. In this specification, the wording "receive data from a controller" means that the data are received directly from that controller or that the data are received from that controller via another controller or controllers. The third data W3 is compared with the fourth data W4 of information on the weight, i.e., the data of the weight of the alloyed metal that is measured by means of the first weighing scale 112 to see if the difference, i.e., the second difference in the weights, is within a predetermined third threshold T3. If the second difference in the weights is greater than the third threshold T3, an error signal is generated. Namely, if the second difference in the weights were great, the alloyed metal would spill out so as not to be fed to the ladle 10 for reaction. Thus the error signal is generated. To act as the error signal, the controller 110 may sound an alarm or turn on an alarm lamp or may send an error signal to another controller. The controller 110 may transmit the fourth data W4 of information on the weight to the controller 120 for the device for feeding an alloyed metal or to any other controller or controllers.

The controller 110 for the bogie for receiving molten metal that has a mechanism for transferring transmits the data on the weight of the molten metal, i.e., the first data W1 of information on the weight, which molten metal has been poured from the melting furnace F to the ladle 10 for reaction, to the controller 140 for the pouring machine. Then it continues to monitor the weight of the molten metal. When the molten metal is poured from the melting furnace F to the ladle 10, the reaction between the alloyed metal and the molten metal starts in the ladle 10. That reaction causes the measurement by the first weighing scale 112 to vary up and down. That is, since a violent bubbling phenomenon occurs, the measurement varies. Especially when the alloyed metal contains a spheroidizing element, such as magnesium, the weight of the molten metal is measured to see when the fading starts. The variations of the measurement increase and then decrease. Fading is judged to start when the variations become less than a predetermined value. When the controller 110 detects the start of fading, it transmits a fading-started signal, which is a signal of the start of fading, to another controller or other controllers. Alternatively, the controller 110 may calculate an elapsed time from the start of fading and send the fading-time signal, which is the elapsed time TF that is calculated. In this way, by detecting the start of fading based on the variations of the measurement, the elapsed time TF can be accurately calculated from the start of fading.

The controller 120 for the device for feeding an alloyed metal causes a predetermined alloyed metal to be sent from one or more hoppers 54 to the hoppers 56 for weighing via the electromagnetic feeder 55. It also causes the gates 58 to open after the alloyed metal is ready to be fed so that the alloyed metal is fed to the ladle 10 for reaction through the chute 52. The controller 120 controls the electromagnetic feeder 55 so as to send a predetermined amount of the alloyed metal to the hoppers for weighing. The data on the weight of the alloyed metal that is stored in the hoppers 56 for weighing, which weight is measured by means of the third weighing scale 122, are transmitted to the controller 110 for the bogie for receiving molten metal that has a mechanism for transferring as a third data W3 of information on the weight. If the alloyed metals are fed from the plurality of hoppers 54, the data on the sum of the weights measured by multiple load cells 122 is transmitted as the third data W3 of information on the weight. The data may be transmitted to another controller or other controllers. As discussed above, the controller 110 uses the third data W3 to compare it to the fourth data W4, which are the data on the weight of the alloyed metal that is measured by means of the first weighing scale 112, to see if the difference, i.e., the second difference in the weights, is within the third threshold T3.

The controller 130 for the bogie for transporting the ladle for pouring controls the bogie 70 for transporting the ladle for pouring to travel. That is, it causes the bogie 70 to move from the position P4 for transferring the molten metal to the pouring machine 100. At the position of the pouring machine 100, it causes the ladle 60 for pouring to be transferred to the pouring machine 100 by means of a conveyor. By the system 1 for transporting molten metal as in FIG. 1, the ladle 60 that stores the molten metal is transferred to the conveyor S1 for the filled ladle. The conveyor S1, which receives the ladle 60, transfers it to the pouring machine 100. The ladle 60, after the pouring of the molten metal into a mold is finished, is transferred to the conveyor S2 for the empty ladle. It is transferred from the conveyor S2 to the bogie 70. That is, the bogie 70 moves the position of the conveyor S1 to the position of the conveyor S2. Since the conveyor S1 and the conveyor S2 are provided, multiple ladles 60 for pouring can be simultaneously used. Thus waiting time at each device can be shortened so that the efficiency is enhanced. The bogie 70 that receives the ladle 60 that has poured molten metal into molds from the pouring machine 100 moves to the position P4 for transferring the molten metal. Again the molten metal is received from the ladle 10 for reaction. Incidentally, the operations of the conveyor S1 and the conveyor S2 may be controlled by the controller 130 for the bogie for transporting the ladle for pouring, by the controller 140 for the pouring machine, by the main controller 150 for the transporting zone, by the main controller 160 for the pouring zone, or by any other controller.

The controller 140 for the pouring machine controls the operations of the pouring machine 100. Namely, it causes the ladle 60 for pouring to be tilted so that the molten metal in it is poured into the mold D. In doing so, the weight of the molten metal in the ladle 60 is measured by means of the second weighing scale 142 while the molten metal is poured into the mold D. Thus an accurate amount of the molten metal is poured into the mold D.

The controller 140 for the pouring machine receives the first data W1 of information on the weight from the controller 110 for the bogie for receiving molten metal that has a mechanism for transferring. The first data W1 indicates the weight of the molten metal that has been received by the ladle 10 for reaction from the melting furnace F. It also receives the second data W2 of information on the weight, which indicates the weight of the molten metal that has been transferred to the ladle 60 for pouring and is measured by means of the second weighing scale 142. If the first difference in the weights, which is the difference between the first data W1 and the second data W2, is greater than the first threshold T1, an error signal is generated. Namely, the alloyed metal may spill while being transported from the melting furnace F to the pouring machine 100 so that the amount of it is reduced. To act as the error signal, the controller 140 may sound an alarm or turn on an alarm lamp or may send an error signal to another controller or other controllers.

The controller 140 for the pouring machine receives the fading-started signal from the controller 110 for the bogie for receiving molten metal that has a mechanism for transferring to calculate the elapsed time TF that is calculated from the start of fading. Alternatively, it may receive the elapsed time TF. As is obvious from the above discussion, the elapsed time TF or the fading-started signal (hereafter, the term "the elapsed time TF" is used) is determined for each ladle 10 for reaction and is taken over to the ladle 60 for pouring that receives the molten metal from that ladle 10. Thus the elapsed time TF is determined for each ladle 60 that is to be transferred to the pouring machine 100. Namely, in the system 1 for transporting molten metal, the elapsed time TF is given as one piece of information for each ladle, and there are multiple ladles 10. Thus they are identified to see how to connect them with the respective ladles 10. The controller 140 recognizes the elapsed time TF for the ladle 60 for pouring that is held by the pouring machine 100.

If the elapsed time TF is greater than a predetermined second threshold T2, the controller 140 for the pouring machine generates an error signal. Namely, the effects of the alloyed metal may have been depleted because of fading. If the effects of the alloyed metal were depleted, the possibility of poor spheroidizing would increase. After the error signal is generated, generally the controller 140 causes the ladle 60 to stop pouring the molten metal. The molten metal that remains in the ladle 60 is to be transferred to a starting block U. The starting block U is a container for receiving the molten metal. It has a chute onto which the ladle 60 pours the molten metal by being tilted. The ladle 60 is tilted in the direction that is opposite the direction for pouring the molten metal into the mold D. By doing so, the molten metal is transferred from the ladle 60 to the starting block U via the chute. The molten metal in the starting block U is transported to the furnace so as to be reused. Alternatively, the ladle 60 may be transported from the pouring machine 100 to a drainage system (not shown) to be drained. To act as the error signal, the controller 140 may sound an alarm or turn on an alarm lamp or may send an error signal to another controller or other controllers.

The second threshold T2, which is the elapsed time from the start of fading to an occurrence of poor spheroidizing, varies depending on the kind or amount of the alloyed metal. It may vary depending on the size of the ladle 10 or the way to transport it (the vibrations of the ladle, etc.). Thus, the second threshold T2 must be determined so as to be suitable for the molten metal in the ladle 60. For example, the second thresholds T2 are preliminarily stored in the controller 140. Based on the kind and amount of the alloyed metal that is fed from the device 50 for feeding an alloyed metal to the ladle 10 and on the measurements of the amount of the alloyed metal, etc., that is received by the ladle 10, a proper value is used. Incidentally, the second threshold T2 may be determined by the controller 110 for the bogie for receiving molten metal that has a mechanism for transferring, by the controller 120 for the device for feeding an alloyed metal, by the controller 130 for the bogie for transporting the ladle for pouring, or by any other controller.

Next, the operation of the system 1 for transporting molten metal is discussed. The bogie 20 that mounts an empty ladle 10 for reaction moves to the position P2 for feeding the alloyed metal under the control of the controller 110 for the bogie for receiving molten metal that has a mechanism for transferring. The controller 110 transmits the data on the position of the bogie 20 to the other controllers.

In the device 50 for feeding an alloyed metal, the predetermined amounts of the alloyed metals from the hoppers 54 are stored in the respective hoppers 56 for weighing under the control of the controller 120. The data on the weights of the alloyed metals that are stored are measured by means of the third weighing scales 122 to be transmitted to the controller 120. Then they are transmitted from the controller 120 to the controller 110 as the third data W3 of information on the weight. When the bogie 20 moves to the position P2, the gates 58 are opened so that the alloyed metals are fed to the ladle 10 through the chute 52.

When the alloyed metals are fed to the ladle 10, the weight of the alloyed metals that have been fed is measured by means of the first weighing scale 112. The data on the measured weight is transmitted to the controller 110 for the bogie for receiving molten metal that has a mechanism for transferring as the fourth data W4 of information on weight. The controller 110 compares it with the third data W3. If the difference, i.e., the second difference in the weights, is greater than the third threshold T3, an alarm is generated. When the alarm is generated, the operator judges if the operation on that ladle 10 should be stopped or if it should be continued to the next step. Incidentally, the ladle 10 may be automatically emptied and then started at the initial step. If the second difference in the weights is the same as, or less than, the third threshold T3, the operation proceeds to the next step. Incidentally, after feeding the alloyed metals and measuring the weight of them, the covering agent may be fed from the device 50 to the ladle 10 to cover the alloyed metals.

The bogie 20 that mounts the ladle 10, to which the alloyed metals have been fed, moves to the position P1 for receiving the molten metal under the control of the controller 110. There the predetermined amount of the molten metal is poured from the melting furnace F into the ladle 10. The weight of the molten metal that has been poured is measured by means of the first weighing scale 112, so that its data are transmitted to the controller 110. They are transmitted as the first data W1 of information on the weight from the controller 110 to the controller 140 for the pouring machine. The identification of that ladle 10 is jointly transmitted. The weight of the molten metal in the ladle 10 is continuously measured so that the data are transmitted to the controller 110. The term "continuously measured" may mean to measure at predetermined intervals.

When the ladle 10 receives the molten metal, the bogie 20 quickly moves to the position P3 for the reaction under the control of the controller 110. Namely, the ladle 10 for reaction is transported into the room 90 for a reaction before the reaction of the alloyed metals with the molten metal becomes violent. Since the reaction occurs in the room 90 for a reaction, the molten metal that violently reacts is prevented from being scattered in the foundry. Further, dust or gas that is generated by the reaction can be discharged from the foundry through a duct.

The controller 110 for the bogie for receiving molten metal that has a mechanism for transferring detects the start of fading based on the weights of the molten metal in the ladle 10 for reaction, which weights are continuously measured by means of the first weighing scale 112. Because of the bubbling caused by the violent reaction of the molten metal with the alloyed metal, the weights that are measured by means of the first weighing scale 112 vary greatly. Further, the controller 110 causes the bogie 20 to move to the position P4 for transferring the molten metal. This is because once the variations of the weights that are measured by means of the first weighing scale 112 descend to a predetermined level (a first stage), the ladle 10 can no longer be kept in the room 90 for a reaction. The bogie 20 is quickly moved to the position P4 for transferring the molten metal, so that the molten metal can as soon as possible be poured into the mold D after the start of fading.

When the variations of the weights that are measured by means of the first weighing scale 112 become smaller to thereby descend to a predetermined level (a second stage), it is determined that the end of the reaction of the molten metal and the alloyed metal has occurred and that the start of fading has begun at this time. The controller 110 transmits the fading-started signal, which indicates the start of fading, and transmits the identification of that ladle for reaction to the controller 140 for the pouring machine. Alternatively, when the start of fading is determined, the controller 110 may calculate the elapsed time TF from the start of fading, to transmit it as the fading-time signal.

In the bogie 20, which has moved to the position P4 for transferring the molten metal, the molten metal in the ladle 10 for reaction is transferred to the ladle 60 for pouring. The bogie 70 for transporting the ladle for pouring that mounts the empty ladle 60 on it stands available under the control of the controller 140 for the pouring machine at the position where the molten metal is transferred. The bogie 20 transfers the molten metal by moving up and tilting the ladle 10 by means of the device 40 for tilting (see FIG. 6) and by means of a pantagraph-type device 28 for vertically moving the table (see FIG. 7) or a vertically-moving table 34 (see FIG. 6), which are discussed below. Alternatively, it can transfer the molten metal by tilting the ladle 10 by using the sector gear 44 (see FIG. 8). While the molten metal is transferred from the ladle 10 to the ladle 60, an inoculant may be added to the molten metal, for example, by means of a device 80 for inoculating, while transferring the molten metal.

After the molten metal is transferred to the ladle 60 for pouring, the bogie 70 moves to the position where the ladle 60 is transferred to the conveyor S1 for the filled ladle. There the ladle 60 is transferred from the bogie 70 to the conveyor S1 for the filled ladle. It is transported to the pouring machine 100 by means of the conveyor S1. There it is transferred to the pouring machine 100.

In the pouring machine 100, after receiving the ladle 60, the weight of the molten metal in the ladle 60 is measured by means of the second weighing scale 142 so that the data on it is transmitted to the controller 140 for the pouring machine as the second data W2 of information on the weight. At the same time, it receives the identification of that ladle 10 from the controller 110 for the bogie for receiving molten metal that has a mechanism for transferring. The controller 140 compares the first data W1 of information on weight with the second data W2 of information on weight. They relate to the same identification of the ladle 10. If that difference, i.e., the first difference in the weights, is greater than the first threshold T1, an alarm is generated. After the alarm is generated, the operator judges if the operation on that ladle 60 should be stopped or if it should be continued to the next step. Incidentally, the ladle 60 may be automatically emptied and then started at the initial step. To cause the ladle 60 to be empty, the pouring machine 100 may move to the front of the starting block U so that the molten metal in the ladle 60 is transferred to the starting block U. If the first difference in the weights is equal to, or less than, the first threshold T1, the operation proceeds to the next step.

In the pouring machine 100 the molten metal is poured from the ladle 60 into the mold D. After a predetermined amount of the molten metal is poured into a mold D, the line DL of molds moves by the length of one mold so that a new mold D comes to the front of the pouring machine 100. Then the pouring machine 100 pours the molten metal into the new mold D. During the pouring operation, the weight of the molten metal in the ladle 60 is measured by means of the second weighing scale 142. Namely, the weight of the molten metal that remains in the ladle 60 is measured. Thus the actual weight of the molten metal that has been poured into the mold D can be measured so that the predetermined amount of the molten metal is accurately poured into the mold D. Further, since the molten metal can be poured into the mold D while the weight of the molten metal to be poured is measured, a pouring operation can be carried out while the flow is accurately controlled. Incidentally, if the movement of the line DL of molds by the length of one mold takes a long time, the pouring machine 100 may travel on the rail R3 in the same direction and at the same speed as the mold D moves on the line DL of molds while the molten metal is being poured from the ladle 60 into the mold D. Thus no time for moving the line DL of molds by the length of one mold is wasted. In this case the pouring machine 100 moves back on the rail R3 by the length of one mold to pour the molten metal into the next mold. Alternatively, it does not need to move back for every mold, but may move back to the position where the ladle 60 is transferred to the conveyor S2 for the empty ladle after a predetermined amount of the molten metal has been poured from the ladle 60.

The controller 140 for the pouring machine calculates the elapsed time TF from the start of fading based on the fading-started signal for the molten metal. The fading-started signal is received from the controller 110 for the bogie for receiving molten metal that has a mechanism for transferring. Alternatively, it may receive the elapsed time TF from the start of fading for the molten metal from the controller 110. If the elapsed time TF is greater than the second threshold T2, an alarm is generated. After the alarm is sent, pouring from the ladle 60 to the mold D is stopped. But the operator may judge that the operation should be continued to the next step.

After the pouring from the ladle 60 to the mold D is stopped, the pouring machine 100 moves to the front of the starting block U so that the molten metal in the ladle 60 is transferred to the starting block U. Thus the ladle 60 is tilted in the direction that is opposite that for pouring the molten metal into the mold D, to transfer the molten metal to the starting block U. The molten metal that has been transferred to the starting block U is returned to the furnace to be reused. Incidentally, a drainage system (not shown) may be provided to tilt the ladle 60 for transferring the molten metal from it to the starting block. After transferring the ladle 60 from the pouring machine 100 to the drainage system, the molten metal is transferred to the starting block. If much molten metal remains in the ladle 60, the ladle 60 may be lifted and transported by means of a crane so that the molten metal that remains in the ladle 60 is directly returned to the furnace.

After the ladle 60 becomes empty or after the weight of the molten metal in the ladle 60 becomes less than a predetermined value, the pouring machine 100 moves the ladle 60 to the position where it is transferred to the conveyor S2 for the empty ladle. The ladle 60 is transferred from the pouring machine 100 to the conveyor S2. The ladle 60 is transported to the bogie 70 for transporting the ladle for pouring by means of the conveyor S2. The bogie 70 stands available at the position next to the conveyor S2. Thus the ladle 60 is transferred to the bogie 70 and moves to the position where it receives the molten metal.

By the system 1 for transporting molten metal, feeding the alloyed metal to the ladle 10 for reaction can be automated. Further, transporting the molten metal from the ladle 10 for reaction to the pouring machine 100 can be automated. If the second difference in the weights is greater than the third threshold T3, an alarm is generated. The second difference in the weights is the difference between the third data W3 of information on the weight, i.e., the weight of the alloyed metal that is measured by means of the third weighing scale 122, and the fourth data W4 of information on the weight, i.e., the weight of the alloyed metal that has been put into the ladle 10 and is measured by means of the first weighing scale 112 of the bogie 20. Thus it can be checked to see if the alloyed metal is properly fed to the ladle 10. When the molten metal is poured into the ladle 10 to which the alloyed metal has been fed, thereafter the weight is measured. Based on the variations of the weights the start of fading is detected. Thus the start of fading can be accurately assessed. If the first difference in the weights is greater than the first threshold T1, an alarm is generated. The first difference in the weights is the difference between the weight of the molten metal that is measured when it is in the ladle 10 and the weight of the molten metal that has been transferred from the ladle 10 to the ladle 60. Thus trouble, such as a leak or a spill of the molten metal during the transportation of it from the melting furnace F to the pouring machine 100, can be found. Further, if the elapsed time TF from the start of fading of the molten metal that is being poured into the mold D is over the third threshold T3, the pouring machine 100 generates an alarm. Thus poor spheroidizing that is caused by fading can be prevented. As a result, a cast product with stable qualities can be safely produced.

Figure 6:
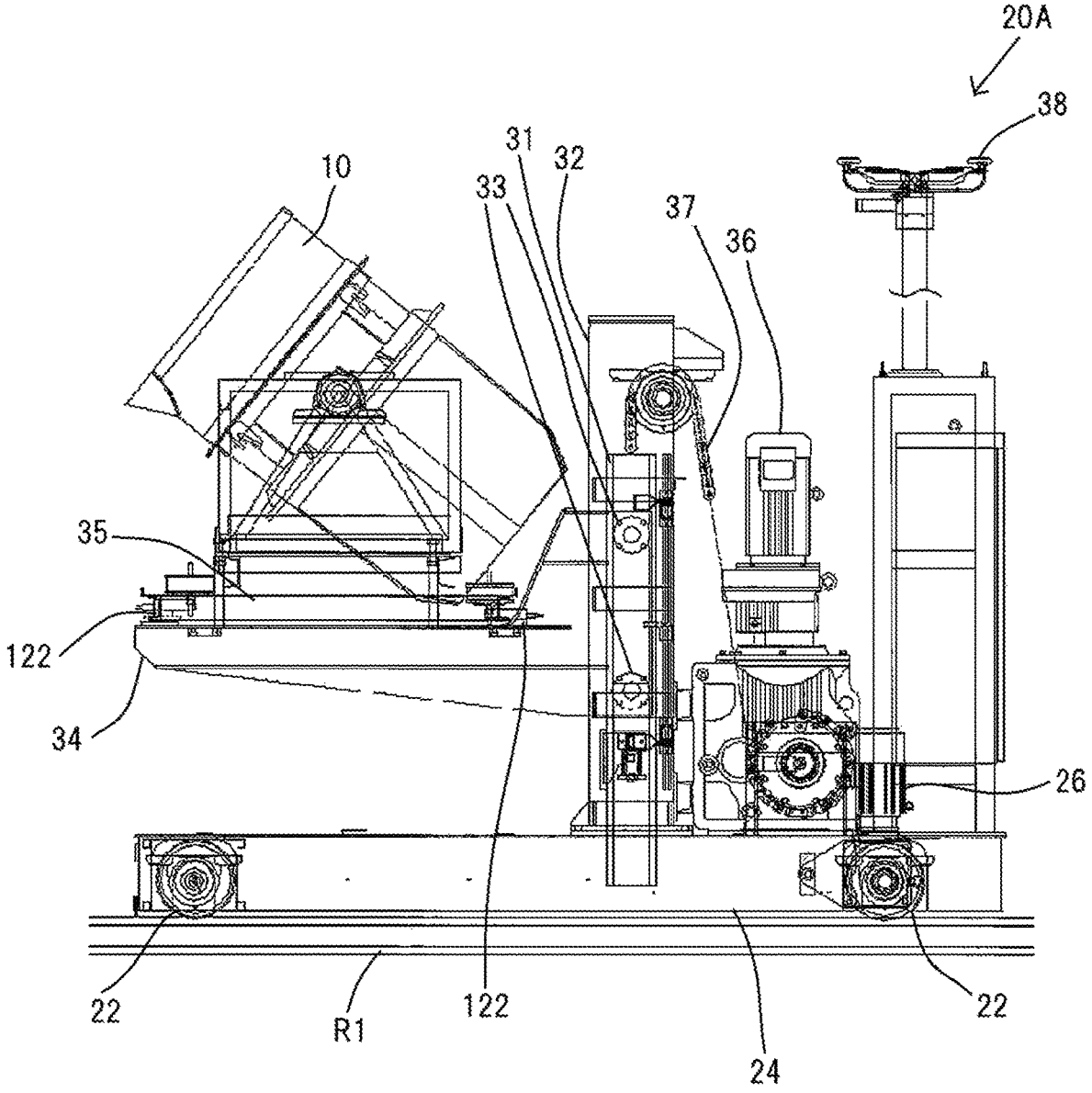
FIG. 6 is a side view of an example of the forklift-type bogie for receiving molten metal that has a mechanism for transferring.

Next, the details of the bogie 20 for receiving molten metal that has a mechanism for transferring are discussed. FIG. 6 is a side view of a forklift-type bogie 20A for receiving molten metal that has a mechanism for transferring, which is an embodiment. The bogie 20A has a body 24 that has wheels 22 to travel on a rail R1. On the body 24 a mechanism 26 for travelling, which is a driving mechanism to cause the body 24 to travel, is provided. A pair of guiding columns 32 are provided on the body 24. A frame 34 for vertically moving that is horizontally elongated and that places the ladle 10 on it and can vertically move above the body 24 is supported by the guiding columns 32. A mechanism 35 for moving the ladle is provided on the frame 34 for vertically moving to horizontally move the ladle 10 (in the direction perpendicular to that of the travel of the bogie 20A). The mechanism 35 for moving the ladle is typically a roller conveyor. It moves the ladle 10 horizontally so that the ladle 10 receives the molten metal from the melting furnace F at an appropriate position and so that transferring the molten metal to the ladle 60 is facilitated. Further, it moves the ladle 10 to the center while the bogie 20A travels so that vibrations of the ladle 10 become weak and so that the stability of the bogie 20A as a whole increases. A load cell 112, which is the first weighing scale, is provided between the frame 34 and the mechanism 35 for moving the ladle. Typically, the load cells 112 are provided at four positions. A mechanism 36 for vertically moving that is a driving mechanism to vertically move the frame 34 is provided on the body 24.

The frame 34 for vertically moving has two holding rollers 33 that are separated. On the guiding columns 32, a guide plate 31 for the rollers is vertically placed so that the holding rollers 33 roll on it. Since the two holding rollers 33 that are vertically separated roll on the guide plate 31, the frame 34 can bear the moment that is generated in it because of the ladle 10, which is heavy. The frame 34 is suspended at two points by means of chains 37 so as not to lean in the direction that is perpendicular to the plane of the paper of FIG. 6. The mechanism 36 rotates a sprocket that is connected to the output shaft of a motor for vertically moving via a reduction gear so as to reel in the chain 37. Thus the frame 34 is suspended and vertically moved by means of the chain 37.

The device 40 for tilting is provided on the frame 34 so as to support and tilt the ladle 10 for reaction. The device 40 typically has a rack that is provided on the frame 34, a pair of rotating shafts that are horizontally elongated and that support the ladle 10 from the sides, and a tilting mechanism that rotates the rotating shafts.

On the body 24 of the bogie, the mechanism 26 for travelling and the mechanism 36 for vertically moving the frame for vertically moving the ladle are located apart from the position where the ladle 10 is placed, namely, the ladle is placed on the front side position of the frame 34. Since the mechanism 26 and the mechanism 36 are located in this way, equipment that needs time for repair, such as a motor, would not be damaged even if the molten metal were to leak from the ladle 10 because of degradation. Thus such a repair could be quickly carried out. Further, motors for the mechanism 26 and the mechanism 36 are preferably located above the bottom of the ladle 10 when the frame 34 is lowered. Since any degradation of the ladle 10 would generally occur near the bottom of it, molten metal that would leak would be prevented from dropping on the motors. On the upper plate of the frame 34 and the floor of the body 24 openings that allow leaked molten metal to downwardly pass through them are preferably formed. Power-receiving equipment 38 that is used to string a power cable for receiving power and a communication cable for communicating is preferably located apart from the position where the ladle 10 is placed.

By using the bogie 20A or the like, the ladle 10 is easily lifted by moving the frame 34 upward. While it is being moved upward the ladle 10 for reaction is tilted by means of the device 40 for tilting so that the molten metal is transferred to the ladle 60 for pouring. Thus transferring the molten metal can be automatically and safely carried out. Since all operations are electrically driven, fire can be prevented even if the molten metal were to leak. Incidentally, though the ladle 10 will be tilted in the direction that the bogie 20A is to travel, it may be tilted in the direction that is perpendicular to the direction of the travel. If the ladle 10 is tilted toward the furnace F, the ladle 10 can be placed at the position that appropriately matches the line of the flow of the molten metal from the furnace F. Thus the advantageous effects that are discussed below can be obtained.

The controller 110 for the bogie for receiving molten metal that has a mechanism for transferring may be located near a route of the bogie 20A along the rail R1 or may be mounted on the body 24 of the bogie. If it is mounted on the bogie, it is preferably located apart from the position where the ladle 10 is placed, like the power-receiving equipment 38 is placed.

Figure 7:
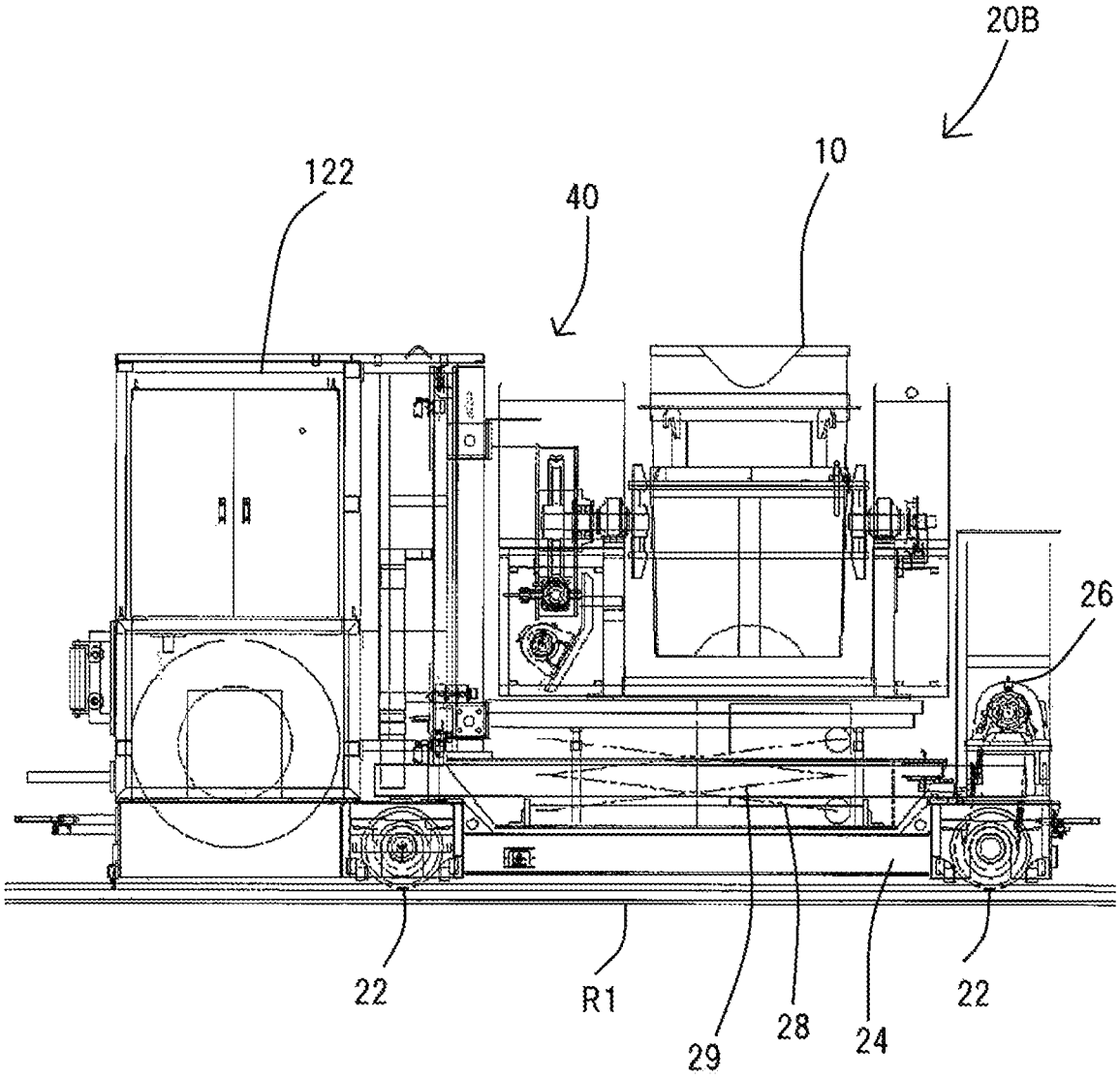
FIG. 7 is a side view of an example of the pantagraph-type bogie for receiving molten metal that has a mechanism for transferring.

FIG. 7 is a side view of a pantagraph-type bogie 20B for receiving molten metal that has a mechanism for transferring, which is an embodiment. While the bogie 20A vertically moves the ladle 10 by means of the frame 34, the bogie 20B does so by means of a pantagraph-type device 28 for vertically moving the table. That is, the pantagraph-type device 28 is provided on the body 24 of the bogie. The device 40 for tilting is placed on the pantagraph-type device 28. As shown by the dotted lines in FIG. 7, the pantagraph-type device 28 has a linkage 29 where a rhombus is formed by two pairs of parallel beams so that the fulcrums where the beams cross are pivotally connected. The linkage 29 may have three or more pairs of parallel beams. By changing the distance between two fulcrums, as, say, by means of an oil cylinder, the ladle 10 can be vertically moved. Alternatively, by changing the angle to the horizontal plane of a beam by means of a rotary movement that is obtained by a motor and a reduction gear, the ladle 10 can be vertically moved. Thus the ladle 10 for reaction can be vertically moved by a simple structure. Further, if an oil cylinder is used, a large force can be easily and economically obtained. If a motor and a reduction gear are used, they are both electrically driven, so that a fire can be prevented even if the molten metal were to leak. The other parts are the same as those of the forklift-type bogie 20A. Thus a duplicate discussion is omitted.

The bogie 20B is structured so that the ladle 10 for reaction can be tilted toward the furnace F. Since the ladle 10 is upwardly moved and tilted toward the furnace F when receiving the molten metal from the furnace F, it can be placed at a position that appropriately matches the line of the flow of the molten metal. Thus the molten metal is prevented from hitting the side wall of the ladle 10. It is received by the bottom of the ladle 10. Thus no abrasion of the ladle 10 occurs. The reliability of the system 1 for transporting molten metal can be enhanced.

Figure 8:
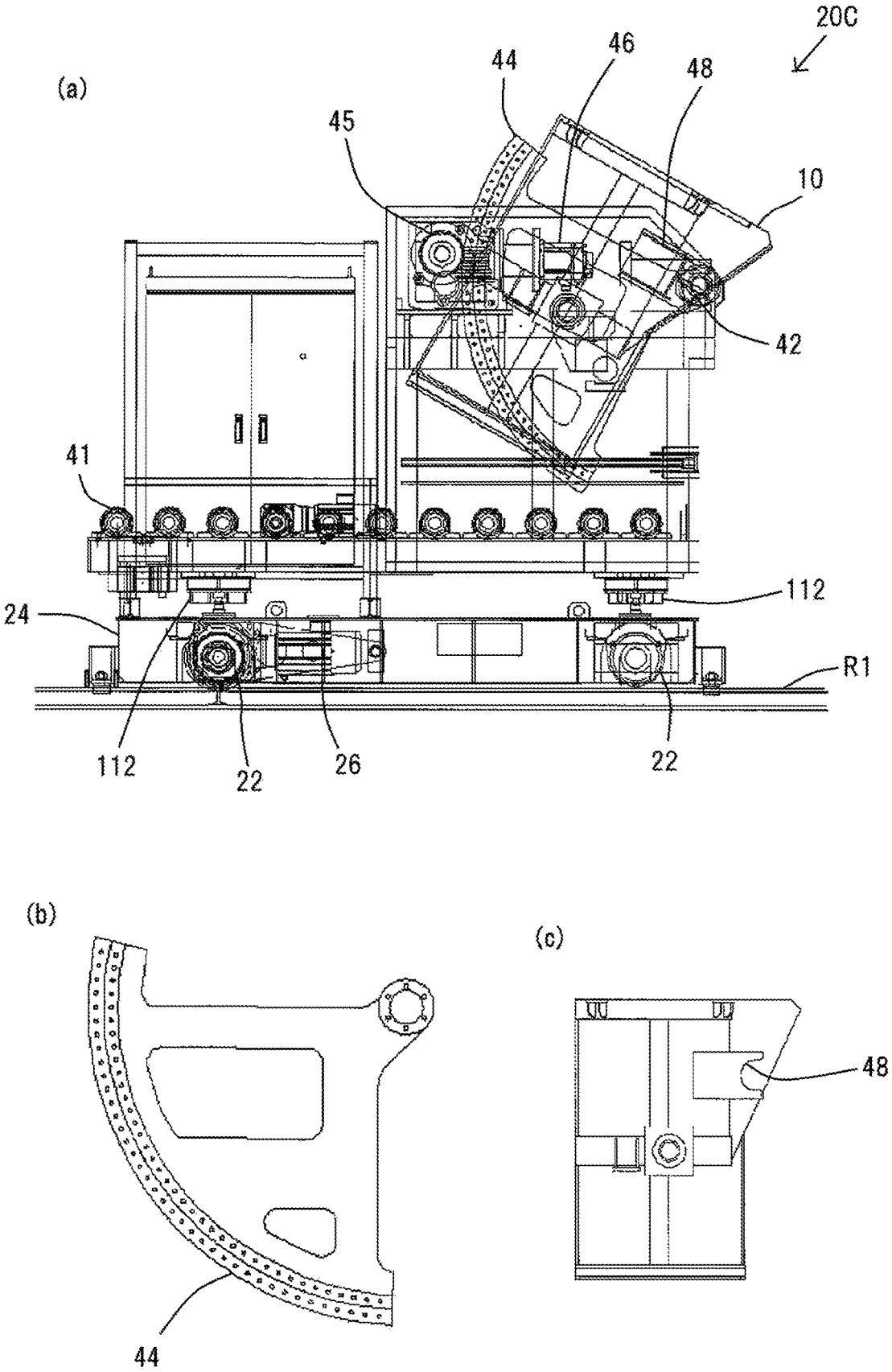
FIG. 8(*a*) is a side view of the sector gear-type bogie for receiving molten metal that has a mechanism for transferring.

FIG. 8 is a side view of a sector gear-type bogie 20C for receiving molten metal that has a mechanism for transferring, which is an embodiment. FIG. 8(*a*) shows the whole device. FIG. 8(*b*) shows a sector gear 44. FIG. 8(*c*) illustrates a support 48 for the rotation of the ladle that is provided to the ladle 10 for reaction. In the sector gear-type bogie 20C a roller conveyor 41 for transporting the ladle 10 is provided on the body 24 of the bogie. Though the ladle 10 is transported in the direction that the bogie 20C travels in FIG. 8(*a*), it may be transported in the direction that is perpendicular to that of the travel. The roller conveyor 41 moves the ladle 10 for the purpose that is the same as that of the mechanism 35 for moving the ladle of the forklift-type bogie 20A. Further, it causes the support 48 for the rotation of the ladle 10 to engage the shaft 42 for transferring the molten metal of the device 40 for tilting. The roller conveyor 41 may be placed on the body 24 through pillars, etc., not directly on the body 24. Alternatively, it can be placed on the frame 34 of the forklift-type bogie 20A or the linkage 29 of the pantagraph-type bogie 20B. The load cell 112, which is the first weighing scale, is placed between the roller conveyor 41 and the body 24.

The device 40 for tilting has a shaft 42 for transferring the molten metal that supports the ladle 10 and that is the center of rotation for tilting the ladle 10. It also has the sector gear 44 that moves forward and backward around the shaft 42. It also has a pinion 45 that engages the sector gear 44 to move it forward and backward around the axis. It also has a driving motor 46 to drive the pinion 45. The sector gear 44 is fixed to the ladle 10 at a position that differs from the position of the shaft 42, so as to move forward and backward around the axis with the ladle 10. Since the sector gear 44, which moves forward and backward around the axis together with the ladle 10, is driven by means of the pinion 45, the ladle 10 needs only a small amount of power to drive it. Further, since the operations are electrically driven, fire can be prevented even if the molten metal were to leak. The other parts are the same as those of the forklift-type bogie 20A. Thus a duplicate discussion is omitted.

Figure 9:
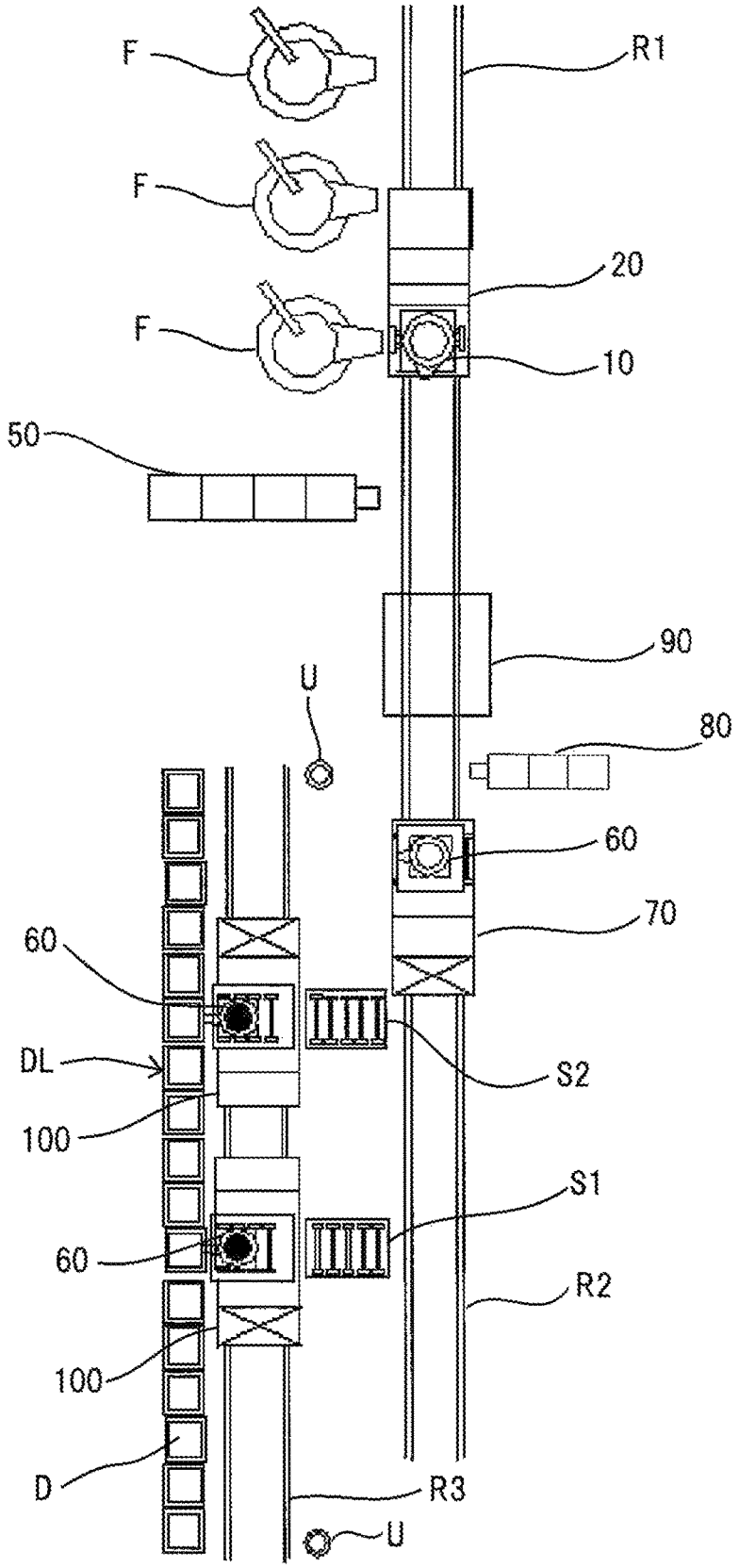
FIG. 9 is a plan view of the foundry that has the system for transporting molten metal, which is an embodiment of the present invention, and which differs from that in FIG. 1.

FIG. 9 is a plan view of a foundry that has the system 2 for transporting molten metal, as an embodiment of the present invention, which system 2 differs from the system 1 as in FIG. 1. In the system 2 for transporting molten metal, the rail R1, on which the bogie 20 travels, is aligned with the rail R2 on which the bogie 70 travels. In this case, the bogie 20 preferably moves the ladle 10 in the direction to travel, or the bogie 70 preferably moves the ladle 60 in the direction to travel. The other parts are the same as those of the system 1 for transporting molten metal. Thus a duplicate discussion is omitted.

Incidentally, the bogie 20 may travel to the conveyor S1 for the filled ladle, without the bogie 70, so that the molten metal is transferred to the ladle 60, which stands available on the conveyor S1. The ladle 60 is transferred to the pouring machine 100 so that the molten metal is poured into the mold D. After pouring the molten metal into molds the empty ladle 60 is transferred to the conveyor S1. The molten metal is again transferred from the ladle 10. In this case no conveyor S2 for the empty ladle may be installed. The device 80 for inoculating while transferring the molten metal is placed on the side of the rail R2 of the conveyor S1.

In the above discussion, the system 1, 2 for transporting molten metal has the bogie 70 for transporting the ladle for pouring and the rail R2 to transport the ladle 60 for pouring from the position P4 for transferring the molten metal to the pouring machine 100. However, the molten metal may be directly transferred from the ladle 10 for reaction to the ladle 60 for pouring that is held by the pouring machine 100, without using the bogie 70 and the rail R2. Namely, the position P4 for transferring the molten metal is the same position as that of the pouring machine 100.

Any two of the position P1 for receiving the molten metal, the position P2 for feeding the alloyed metal, the position P3 for the reaction, and the position P4 for transferring the molten metal, may be the same position. The shape of the system 1, 2 for transporting molten metal may be arbitrarily changed depending on the arrangements of the furnace F and the line DL of molds.

In the above discussion, the device 50 for feeding an alloyed metal has the controller 120 for the device for feeding an alloyed metal. However, for example, if a constant amount of one kind of the alloyed metal is fed, the device 50 may have a simple configuration, without the need for the controller 120.

Below, the main reference numerals and symbols that are used in the detailed description and drawings are listed.

1, 2 the system for transporting molten metal
10 the ladle for reaction
12 the pocket
20, 20A, 20B, 20C the bogie for receiving molten metal that has a mechanism for transferring
22 the wheels
24 the body of the bogie
26 the mechanism for travelling
28 the pantagraph-type device for vertically moving the table
29 the linkage
31 the guide plate for the roller
32 the guiding columns
33 the holding rollers
34 the vertically-moving table
35 the mechanism for moving the ladle
36 the device for vertically moving the table
38 the power-receiving equipment
40 the device for tilting
41 the roller conveyor
42 the shaft for transferring the molten metal
44 the sector gear
45 the pinion
46 the driver for the sector gear
48 the support for the rotation of the ladle
50 the device for feeding an alloyed metal

51 the conveyor belt
52 the chute
54 the hoppers
55 the electromagnetic feeder
56 the hoppers for weighing
58 the gates
60 the ladle for pouring
70 the bogie for transporting the ladle for pouring
80 the device for inoculating while transferring the molten metal
90 the room for a reaction
100 the pouring machine
110 the controller for the bogie for receiving molten metal that has a mechanism for transferring
112 the first weighing scale (the load cell)
120 the controller for the device for feeding an alloyed metal
122 the third weighing scale (the load cell)
130 the controller for the bogie for transporting the ladle for pouring
140 the controller for the pouring machine
142 the second weighing scale
150 the main controller for the transporting zone
160 the main controller for the pouring zone
D the mold
DL the line of molds
F the melting furnace (the furnace)
P1 the position for receiving the molten metal from the furnace by the ladle for reaction
P2 the position for feeding the alloyed metal from the device for feeding an alloyed metal to the ladle for reaction
P3 the position for the reaction of the alloyed metal with the molten metal
P4 the position for transferring the molten metal from the ladle for reaction to the ladle for pouring
R1 the rail (for the bogie for receiving molten metal that has a mechanism for transferring)
R2 the rail (for the bogie for transporting the ladle for pouring)
R3 the rail (for the pouring machine)
S1 the conveyor for a filled ladle
S2 the conveyor for an empty ladle
T1 the first threshold
T2 the second threshold
T3 the third threshold
T4 the fourth threshold
TF the elapsed time from the start of fading
U the starting block
W1 the first data of information on weight
W2 the second data of information on weight
W3 the third data of information on weight
W4 the fourth data of information on weight
W5 the fifth data of information on weight
W6 the sixth data of information on weight

The invention claimed is:

1. A system for transporting molten metal from a furnace to a pouring machine comprising:

a ladle for reaction that receives molten metal from the furnace so as to transfer the molten metal to a ladle for pouring;

a device for feeding an alloyed metal that feeds an alloyed metal to the ladle for reaction;

the ladle for pouring that receives the molten metal from the ladle for reaction and that transports the molten metal to the pouring machine;

a bogie for receiving molten metal that has a mechanism for transferring, which bogie moves the ladle for reaction among a position for feeding the alloyed metal where the device for feeding an alloyed metal puts the alloyed metal in the ladle for reaction, a position for receiving the molten metal where the ladle for reaction receives the molten metal from the furnace, and a position for transferring the molten metal where the ladle for reaction transfers the molten metal to the ladle for pouring;

a bogie for transporting the ladle for pouring that moves the ladle for pouring from the position for transferring the molten metal so as to transfer the ladle for pouring to the pouring machine; and the pouring machine that receives the ladle for pouring from the bogie for transporting the ladle for pouring and that pours the molten metal into a mold;

wherein the pouring machine has a controller for controlling the pouring machine, wherein the device for feeding an alloyed metal has a controller for controlling the device for feeding an alloyed metal, wherein the bogie for receiving molten metal that has a mechanism for transferring has a controller for controlling the bogie for receiving molten metal that has a mechanism for transferring, wherein the bogie for transporting the ladle for pouring has a controller for controlling the bogie for transporting the ladle for pouring, and wherein at least two of the controllers among the controller for the pouring machine, the controller for the device for feeding an alloyed metal, the controller for the bogie for receiving molten metal that has a mechanism for transferring, and the controller for the bogie for transporting the ladle for pouring, are linked for data communication.

2. The system for transporting molten metal of claim 1, wherein the bogie for receiving molten metal that has a mechanism for transferring has a first weighing scale that weighs the ladle for reaction, wherein the data on the weight of the ladle for reaction that has been measured by the first weighing scale is transmitted to the controller for the bogie for receiving molten metal that has a mechanism for transferring, wherein the pouring machine has a second weighing scale that weighs the ladle for pouring, wherein the data on the weight of the ladle for pouring that has been measured by the second weighing scale is transmitted to the controller for the pouring machine, wherein the controller for the bogie for receiving molten metal that has a mechanism for transferring receives, as first data of information on weight, data on the weight of the molten metal in the ladle for reaction when the molten metal from the furnace has been received by the ladle for reaction, and wherein the controller for the pouring machine receives, as second data of information on weight, data on the weight of the molten metal in the ladle for pouring, which molten metal has been transferred from the ladle for reaction, and further receives the first data of information on weight from the controller for the bogie for receiving molten metal that has a mechanism for transferring, the controller for the pouring machine generating an error signal when a difference between the first data of information on weight and the second data of information on weight exceeds a predetermined first threshold.

3. The system for transporting molten metal of any of claim 1 or 2, wherein the device for feeding an alloyed metal has a hopper for weighing that stores an alloyed metal to be put into the ladle for reaction and a third weighing scale that measures the weight of the alloyed metal in the hopper for weighing, wherein data on the weight of the alloyed metal that is measured by means of the third weighing scale is transmitted to the controller for the device for feeding an alloyed metal as third data of information on weight, wherein the controller for the device for feeding an alloyed metal transmits the third data of information on weight to the controller for the bogie for receiving molten metal that has a mechanism for transferring, wherein the first weighing scale measures the weight of the alloyed metal that is put into the ladle for reaction to transmit the data on the weight to the controller for the bogie for receiving molten metal that has a mechanism for transferring as fourth data of information on weight, and wherein the controller for the bogie for receiving molten metal that has a mechanism for transferring generates an error signal if a difference between the third data of information on weight and the fourth data of information on weight exceeds a predetermined third threshold.

4. The system for transporting molten metal of claim 2, wherein the first weighing scale measures a weight of the ladle for reaction before the alloyed metal is put in the ladle for reaction, to transmit the data on weight to the controller for the bogie for receiving molten metal that has a mechanism for transferring as fifth data of information on weight, wherein the first weighing scale measures the weight of the ladle for reaction after the molten metal is transferred to the ladle for pouring, to transmit the data on weight to the controller for the bogie for receiving molten metal that has a mechanism for transferring as sixth data of information on weight, and wherein the controller for the bogie for receiving molten metal that has a mechanism for transferring generates an error signal if a difference between the fifth data of information on weight and the sixth data of information on weight exceeds a predetermined fourth threshold.

5. The system for transporting molten metal of claim 1, further comprising:

a device for inoculating while transferring the molten metal, the device inoculating the molten metal with an inoculant, which molten metal is being transferred from the ladle for reaction to the ladle for pouring.

6. The system for transporting molten metal of claim 3, wherein at least two of the positions among the position for feeding the alloyed metal, the position for receiving the molten metal, and the position for transferring the molten metal where the bogie for receiving molten metal that has a mechanism for transferring travels, are the same.

7. The system for transporting molten metal of claim 6, wherein the bogie for receiving molten metal that has a mechanism for transferring has a device for tilting that supports and tilts the ladle for reaction so as to transfer the molten metal from the ladle for reaction to the ladle for pouring.

8. The system for transporting molten metal of claim 7, wherein the bogie for receiving molten metal that has a mechanism for transferring has a body of the bogie that has wheels to travel on a track, and a pantagraph-type device for vertically moving a table, which device is provided on the body of the bogie and vertically moves the device for tilting by means of a pantagraph.

9. The system for transporting molten metal of claim 7, wherein the bogie for receiving molten metal that has a mechanism for transferring has a body of the bogie that has wheels to travel on a track, guiding columns that are provided on the body of the bogie, a vertically-moving table that horizontally extends from the guiding columns, that vertically moves above the bogie, and that mounts the device for tilting thereon, and a device for vertically moving the table.

10. The system for transporting molten metal of claim 7, wherein the bogie for receiving molten metal that has a mechanism for transferring has a body of the bogie that has wheels to travel on a track and a roller conveyor that is provided on the body of the bogie and that moves the ladle for reaction, and wherein the device for tilting has a shaft for transferring the molten metal, which shaft holds the ladle for reaction at a center line to tilt the ladle for reaction, a sector gear that is connected to the ladle for reaction at a position that is different from the center line, to tilt the ladle for reaction, and a driver for driving the sector gear.

11. The system for transporting molten metal of claim 3, wherein the device for feeding an alloyed metal has a plurality of hoppers that store the alloyed metal, a plurality of hoppers for weighing that feed a predetermined amount of the alloyed metal from the plurality of the hoppers to a chute, a plurality of the third weighing scales, and a plurality of gates that supply the alloyed metal that has been measured by the hoppers for weighing to the chute, and wherein the third data of information on weight is the sum of the weights that are measured by the respective third weighing scales.

12. A method for transporting molten metal from a furnace to a pouring machine, comprising the steps of:

transporting a ladle for reaction that receives molten metal from the furnace and that transfers the molten metal to a ladle for pouring to a position for feeding an alloyed metal, where the alloyed metal is put in the ladle for reaction;

putting the alloyed metal in the ladle for reaction;

transporting the ladle for reaction in which the alloyed metal has been put in to a position for receiving the molten metal from the furnace;

causing the ladle for reaction to receive molten metal from the furnace, which ladle for reaction has been transported to the position for receiving the molten metal;

transporting the ladle for reaction that has received the molten metal to a position for transferring the molten metal where the molten metal is transferred to the ladle for pouring; and transferring the molten metal from the ladle for reaction, which has been transported to the position for transferring the molten metal, to the ladle for pouring;

wherein a first difference in the weights is calculated by using a weight of the molten metal that has been transferred from the ladle for reaction to the ladle for pouring by weighing the ladle for reaction and using a weight of the molten metal that has been transferred to the ladle for pouring by weighing the ladle for pouring, and wherein the method further comprises the step of generating an error signal if the first difference in the weights exceeds a first threshold.

13. The method for transporting molten metal of claim 12 further comprising the steps of:

weighing the ladle for reaction that has received the molten metal from the furnace to detect a start of fading based on a variation of the weight and calculating an elapsed time from the start of fading; and generating an error signal if the elapsed time from the start of fading exceeds a predetermined second threshold before the weight of the molten metal in the ladle for pouring after having poured the molten metal into a mold becomes less than a predetermined weight.

14. The method for transporting molten metal of claim 12 or 13 further comprising the steps of:

calculating a second difference in the weights based on a weight of the alloyed metal that is to be put in the ladle for reaction and a weight of the alloyed metal that has been put in the ladle for reaction by weighing the ladle for reaction; and generating an error signal if the second difference in the weights exceeds a third threshold.

15. The method for transporting molten metal of claim 12, wherein at least two of the position for feeding the alloyed metal, the position for transferring the molten metal, and the position for receiving the molten metal, are the same, so that in the step of transporting the ladle for reaction the ladle for reaction is not transported between the same positions.

16. A system for transporting molten metal from a furnace to a pouring machine comprising:

a ladle for reaction that receives molten metal from the furnace so as to transfer the molten metal to a ladle for pouring;

a device for feeding an alloyed metal that feeds an alloyed metal to the ladle for reaction;

the ladle for pouring that receives the molten metal from the ladle for reaction and that pours the molten metal into a mold;

a bogie for receiving molten metal that has a mechanism for transferring, which bogie moves the ladle for reaction among a position for feeding the alloyed metal where the device for feeding an alloyed metal puts the alloyed metal in the ladle for reaction, a position for receiving the molten metal where the ladle for reaction receives the molten metal from the furnace, and a position for transferring the molten metal where the ladle for reaction transfers the molten metal to the ladle for pouring; and a pouring machine that pours the molten metal in the ladle for pouring into the mold;

wherein the pouring machine has a controller for controlling the pouring machine, wherein the bogie for receiving molten metal that has a mechanism for transferring has a controller for controlling the bogie for receiving molten metal that has a mechanism for transferring, and wherein the controller for controlling the pouring machine and the controller for controlling the bogie for receiving molten metal are linked for data communication.

* * * * *